US008618952B2

(12) United States Patent
Mochizuki

(10) Patent No.: US 8,618,952 B2
(45) Date of Patent: Dec. 31, 2013

(54) METHOD OF INTERSECTION IDENTIFICATION FOR COLLISION WARNING SYSTEM

(75) Inventor: Yutaka Mochizuki, Novi, MI (US)

(73) Assignee: Honda Motor Co., Ltd., Tokyo (JP)

( * ) Notice: Subject to any disclaimer, the term of this patent is extended or adjusted under 35 U.S.C. 154(b) by 117 days.

(21) Appl. No.: 13/010,917

(22) Filed: Jan. 21, 2011

(65) Prior Publication Data

US 2012/0188098 A1 Jul. 26, 2012

(51) Int. Cl.
*G08G 1/09* (2006.01)

(52) U.S. Cl.
USPC ..... 340/905; 340/901; 340/902; 340/903; 340/907; 340/936; 340/938; 340/988; 340/435; 340/436; 340/438; 340/995.1; 340/995.11; 340/995.12; 340/995.13; 340/995.14; 340/995.15; 340/995.16; 340/995.17; 340/995.18; 340/995.19; 340/995.2; 340/995.21; 340/995.22; 340/995.23; 340/995.24; 340/995.25; 340/995.26; 340/995.27; 340/995.28; 701/32.2; 701/408; 701/410; 701/411; 701/412

(58) Field of Classification Search
USPC ..... 340/901, 902, 903, 905, 907, 936, 938, 340/988, 435, 436, 438, 995.1–995.28; 701/32.2, 408, 410, 411, 412
See application file for complete search history.

(56) References Cited

U.S. PATENT DOCUMENTS 4,183,264 A * 1/1980 Reed ..... 475/24
4,833,469 A * 5/1989 David ..... 340/901
4,937,752 A * 6/1990 Nanba et al. ..... 701/431
5,043,902 A * 8/1991 Yokoyama et al. ..... 701/442
5,229,941 A * 7/1993 Hattori ..... 701/26
5,235,316 A * 8/1993 Qualizza ..... 340/436
5,289,181 A 2/1994 Watanabe et al.
5,293,163 A * 3/1994 Kakihara et al. ..... 340/995.13
5,485,161 A 1/1996 Vaughn
5,539,398 A 7/1996 Hall et al.
5,638,279 A * 6/1997 Kishi et al. ..... 701/437
5,699,056 A * 12/1997 Yoshida ..... 340/905
5,774,071 A * 6/1998 Konishi et al. ..... 340/988
5,774,073 A * 6/1998 Maekawa et al. ..... 340/995.21
5,798,949 A * 8/1998 Kaub ..... 703/6
5,939,976 A * 8/1999 Sasaki et al. ..... 340/435
5,940,010 A * 8/1999 Sasaki et al. ..... 340/901
5,940,101 A * 8/1999 Sasaki et al. ..... 340/901
5,999,878 A 12/1999 Hanson et al.

(Continued)

FOREIGN PATENT DOCUMENTS

JP 2005006081 1/2005
JP 2005165643 6/2005

(Continued)

OTHER PUBLICATIONS

International Search Report and Written Opinion mailed Dec. 12, 2011 in International Application No. PCT/US2010/60695.

(Continued)

*Primary Examiner* — George Bugg
*Assistant Examiner* — Paul Obiniyi
(74) *Attorney, Agent, or Firm* — Plumsea Law Group, LLC

(57) ABSTRACT

A method of identifying an intersection for a collision warning system is disclosed. The method includes steps of selecting an identified intersection where a driver intends to turn from a set of potential intersections. The collision warning system is then controlled according to the identified intersection.

21 Claims, 13 Drawing Sheets

(56) References Cited

U.S. PATENT DOCUMENTS 6,034,626 A * 3/2000 Maekawa et al. ..... 340/995.21
6,047,234 A 4/2000 Cherveny et al.
6,138,084 A * 10/2000 Mine ..... 702/157
6,144,424 A * 11/2000 Okuda et al. ..... 349/65
6,163,750 A 12/2000 Nojima
6,169,495 B1 1/2001 Koike
6,204,778 B1 * 3/2001 Bergan et al. ..... 340/936
6,225,918 B1 * 5/2001 Kam ..... 340/903
6,278,360 B1 * 8/2001 Yanagi ..... 340/436
6,292,109 B1 * 9/2001 Murano et al. ..... 340/903
6,307,484 B1 * 10/2001 Sasaki et al. ..... 340/903
6,321,160 B1 * 11/2001 Takahashi ..... 701/410
6,356,840 B2 3/2002 Kusama
6,359,552 B1 * 3/2002 King ..... 340/436
6,370,475 B1 4/2002 Breed et al.
6,373,400 B1 * 4/2002 Fujita et al. ..... 340/901
6,385,539 B1 5/2002 Wilson et al.
6,405,128 B1 6/2002 Bechtolsheim et al.
6,405,132 B1 6/2002 Breed et al.
6,408,237 B1 * 6/2002 Cho ..... 701/45
6,433,679 B1 * 8/2002 Schmid ..... 340/435
6,453,234 B1 * 9/2002 Noguchi et al. ..... 701/431
6,484,078 B1 * 11/2002 Kageyama ..... 701/25
6,516,273 B1 2/2003 Pierowicz et al.
6,526,348 B1 2/2003 McDonough
6,526,352 B1 * 2/2003 Breed et al. ..... 701/470
6,587,778 B2 * 7/2003 Stallard et al. ..... 701/117
6,624,782 B2 9/2003 Jocoy et al.
6,640,188 B2 10/2003 Hashida
6,658,356 B2 12/2003 Chen et al.
6,707,391 B1 * 3/2004 Monroe ..... 340/901
6,720,920 B2 4/2004 Breed et al.
6,735,515 B2 5/2004 Bechtolsheim et al.
6,763,301 B2 7/2004 McDonough
6,768,944 B2 7/2004 Breed et al.
6,810,327 B2 * 10/2004 Akashi ..... 701/428
6,816,779 B2 11/2004 Chen et al.
6,825,756 B2 * 11/2004 Bai et al. ..... 340/435
6,831,572 B2 * 12/2004 Strumolo et al. ..... 340/903
6,836,781 B2 12/2004 McDonough
6,853,913 B2 2/2005 Cherveny et al.
6,859,731 B2 2/2005 Takafuji et al.
6,865,479 B2 3/2005 Chen et al.
6,868,410 B2 3/2005 Fortin et al.
7,046,827 B2 5/2006 Chen et al.
7,072,764 B2 7/2006 Donath et al.
7,079,946 B2 7/2006 Hunzinger
7,085,637 B2 8/2006 Breed et al.
7,095,336 B2 * 8/2006 Rodgers et al. ..... 340/903
7,102,496 B1 * 9/2006 Ernst et al. ..... 340/436
7,102,536 B2 * 9/2006 Scholz ..... 340/902
7,110,880 B2 9/2006 Breed et al.
7,124,025 B2 10/2006 Okada et al.
7,124,027 B1 10/2006 Ernst, Jr. et al.
7,133,768 B2 * 11/2006 Mukaiyama ..... 701/400
7,133,775 B2 11/2006 Adamski et al.
7,151,467 B2 * 12/2006 Fujita et al. ..... 340/902
7,194,347 B2 3/2007 Harumoto et al.
7,202,776 B2 * 4/2007 Breed ..... 340/435
7,209,050 B2 * 4/2007 Corcoran, III ..... 340/902
7,209,051 B2 * 4/2007 Shankwitz et al. ..... 340/938
7,274,988 B2 * 9/2007 Mukaiyama ..... 701/301
7,295,925 B2 11/2007 Breed et al.
7,317,406 B2 * 1/2008 Wolterman ..... 340/917
7,330,103 B2 * 2/2008 Boss et al. ..... 340/435
7,342,509 B2 * 3/2008 Tauchi ..... 340/905
7,362,241 B2 * 4/2008 Kubota et al. ..... 340/995.1
7,392,134 B2 * 6/2008 Tauchi et al. ..... 701/469
7,395,138 B2 * 7/2008 Kondoh et al. ..... 701/1
7,406,381 B2 7/2008 Obata
7,418,346 B2 8/2008 Breed et al.
7,426,437 B2 9/2008 Breed et al.
7,433,889 B1 * 10/2008 Barton ..... 1/1
7,440,830 B2 10/2008 Isaji et al.
7,440,850 B2 10/2008 Kim
7,450,029 B2 * 11/2008 Vickas ..... 340/901
7,474,253 B2 * 1/2009 Natsume ..... 342/70
7,486,202 B2 2/2009 Konishi et al.
7,519,472 B1 4/2009 Grigsby et al.
7,554,440 B2 * 6/2009 Kadaba ..... 340/539.22
7,584,050 B2 * 9/2009 Naito et al. ..... 701/419
7,633,383 B2 * 12/2009 Dunsmoir et al. ..... 340/435
7,720,026 B2 * 5/2010 Chen et al. ..... 370/328
7,792,641 B2 * 9/2010 Liu et al. ..... 701/301
7,797,108 B2 * 9/2010 Grimm ..... 701/301
7,821,421 B2 * 10/2010 Tamir et al. ..... 340/901
7,821,422 B2 * 10/2010 Hutchison et al. ..... 340/907
7,835,835 B2 * 11/2010 Wakiyama et al. ..... 701/36
7,873,474 B2 * 1/2011 Yamamoto et al. ..... 701/301
7,881,868 B2 * 2/2011 Greene et al. ..... 701/301
7,983,835 B2 * 7/2011 Lagassey ..... 701/117
7,991,551 B2 * 8/2011 Samuel et al. ..... 701/301
7,991,552 B2 * 8/2011 Samuel et al. ..... 701/301
8,005,616 B2 * 8/2011 Beuschel et al. ..... 701/301
8,068,036 B2 * 11/2011 Ghazarian ..... 340/903
8,085,166 B2 * 12/2011 Tamir et al. ..... 340/901
8,121,755 B2 * 2/2012 Omote et al. ..... 701/36
8,175,800 B2 * 5/2012 Nakayama et al. ..... 701/410
8,244,424 B2 * 8/2012 Subelet et al. ..... 701/24
8,269,652 B2 * 9/2012 Seder et al. ..... 340/903
8,294,594 B2 * 10/2012 Goudy et al. ..... 340/905
8,340,894 B2 * 12/2012 Yester ..... 701/301
8,346,426 B1 * 1/2013 Szybalski et al. ..... 701/28
8,352,111 B2 * 1/2013 Mudalige ..... 701/24
8,352,112 B2 * 1/2013 Mudalige ..... 701/24
2002/0082806 A1 * 6/2002 Kaub ..... 702/182
2002/0145531 A1 * 10/2002 Delaney ..... 340/689
2003/0016143 A1 * 1/2003 Ghazarian ..... 340/901
2003/0134645 A1 7/2003 Stern et al.
2003/0141966 A1 * 7/2003 Strumolo et al. ..... 340/435
2003/0197606 A1 * 10/2003 Epstein ..... 340/466
2004/0145494 A1 * 7/2004 Scholz ..... 340/902
2004/0158390 A1 * 8/2004 Mukaiyama ..... 701/200
2004/0233045 A1 * 11/2004 Mays ..... 340/425.5
2004/0236543 A1 11/2004 Stephens
2005/0021205 A1 * 1/2005 Niwa et al. ..... 701/37
2005/0033505 A1 2/2005 Zatz
2005/0143889 A1 6/2005 Isaji et al.
2006/0173611 A1 8/2006 Takagi et al.
2006/0181433 A1 * 8/2006 Wolterman ..... 340/917
2006/0244632 A1 * 11/2006 Corcoran, III ..... 340/902
2007/0005609 A1 1/2007 Breed
2007/0013497 A1 1/2007 Watanabe
2007/0021915 A1 1/2007 Breed et al.
2007/0027583 A1 2/2007 Tamir et al.
2007/0073463 A1 3/2007 Sherony et al.
2007/0124067 A1 5/2007 Kim et al.
2007/0171095 A1 7/2007 Mochizuki
2007/0208493 A1 9/2007 Downs et al.
2007/0208494 A1 9/2007 Chapman et al.
2007/0208495 A1 9/2007 Chapman et al.
2007/0208496 A1 9/2007 Downs et al.
2007/0208501 A1 9/2007 Downs et al.
2007/0276600 A1 11/2007 King et al.
2007/0280503 A1 12/2007 Kubota et al.
2007/0282532 A1 * 12/2007 Yamamoto et al. ..... 701/301
2008/0015771 A1 1/2008 Breed et al.
2008/0015772 A1 1/2008 Sanma et al.
2008/0021641 A1 1/2008 Kim
2008/0024323 A1 * 1/2008 Kadaba ..... 340/905
2008/0040023 A1 2/2008 Breed et al.
2008/0040029 A1 2/2008 Breed
2008/0040032 A1 2/2008 Ohashi
2008/0042809 A1 * 2/2008 Watts et al. ..... 340/426.16
2008/0042815 A1 2/2008 Breed et al.
2008/0046165 A1 2/2008 Downs et al.
2008/0071465 A1 3/2008 Chapman et al.
2008/0106436 A1 5/2008 Breed
2008/0120025 A1 5/2008 Naitou et al.
2008/0128190 A1 6/2008 Tsutsumi et al.
2008/0133136 A1 6/2008 Breed et al.
2008/0140318 A1 6/2008 Breed
2008/0147253 A1 6/2008 Breed
2008/0150676 A1 * 6/2008 Ennis et al. ..... 340/5.1

(56) References Cited

U.S. PATENT DOCUMENTS

| | | | | |
|---|---|---|---|---|
| 2008/0150786 | A1 | 6/2008 | Breed | |
| 2008/0154495 | A1 | 6/2008 | Breed | |
| 2008/0154629 | A1 | 6/2008 | Breed et al. | |
| 2008/0161986 | A1 | 7/2008 | Breed | |
| 2008/0161987 | A1 | 7/2008 | Breed | |
| 2008/0162036 | A1 | 7/2008 | Breed | |
| 2008/0165018 | A1 | 7/2008 | Breed | |
| 2008/0167819 | A1 | 7/2008 | Breed | |
| 2008/0167821 | A1 | 7/2008 | Breed | |
| 2008/0215202 | A1 | 9/2008 | Breed | |
| 2008/0215231 | A1 | 9/2008 | Breed | |
| 2008/0243378 | A1 | 10/2008 | Zavoli | |
| 2009/0030605 | A1 | 1/2009 | Breed | |
| 2009/0033540 | A1 | 2/2009 | Breed et al. | |
| 2009/0043497 | A1 | 2/2009 | Tashev et al. | |
| 2009/0043506 | A1 | 2/2009 | Breed | |
| 2009/0048750 | A1 | 2/2009 | Breed | |
| 2009/0070031 | A1 | 3/2009 | Ginsberg | |
| 2009/0082917 | A1 | 3/2009 | Adachi | |
| 2009/0224942 | A1 | 9/2009 | Goudy et al. | |
| 2009/0261963 | A1* | 10/2009 | Ault | 340/467 |
| 2010/0033325 | A1* | 2/2010 | Vilkomirski et al. | 340/540 |
| 2010/0045423 | A1* | 2/2010 | Glickman et al. | 340/5.1 |
| 2010/0073194 | A1* | 3/2010 | Ghazarian | 340/901 |
| 2010/0106413 | A1 | 4/2010 | Mudalige | |
| 2010/0223966 | A1* | 9/2010 | Ennis et al. | 70/159 |
| 2010/0252626 | A1* | 10/2010 | Elizondo et al. | 235/385 |
| 2011/0095904 | A1* | 4/2011 | Choi et al. | 340/901 |
| 2011/0153166 | A1* | 6/2011 | Yester | 701/45 |
| 2011/0307139 | A1* | 12/2011 | Caminiti et al. | 701/29 |
| 2012/0095646 | A1* | 4/2012 | Ghazarian | 701/36 |
| 2012/0136895 | A1* | 5/2012 | Johnson | 707/776 |

FOREIGN PATENT DOCUMENTS

| | | |
|---|---|---|
| JP | 2005182310 | 7/2005 |
| JP | 2005242943 | 9/2005 |
| JP | 2006011607 | 1/2006 |
| JP | 2007141114 | 6/2007 |
| JP | 2007200052 | 8/2007 |
| JP | 2007279004 | 10/2007 |
| JP | 2007328573 | 12/2007 |
| JP | 2008009870 | 1/2008 |
| JP | 2008062787 | 3/2008 |
| JP | 2008101458 | 5/2008 |
| JP | 2008132894 | 6/2008 |
| JP | 2008198162 | 8/2008 |
| JP | 2008276688 | 11/2008 |
| JP | 2009031837 | 2/2009 |

OTHER PUBLICATIONS

International Search Report and Written Opinion mailed Apr. 20, 2012 in International Application No. PCT/US2012/021844.

International Preliminary Report on Patentability (including Written Opinion of the ISA) mailed Apr. 19, 2012 in International Application No. PCT/US2010/051761.

Notification of The Transmittal of The International Search Report and The Written Opinion of The International Searching Authority, or The Declaration mailed in PCT Application No. PCT/US2010/051761, mailed Apr. 19, 2012.

International Preliminary Report on Patentability (including Written Opinion of the ISA) mailed Aug. 1, 2013 in International Application No. PCT/US2012/021844.

Japanese Office Action dated Aug. 6, 2013 in Japanese Patent Application No. 2012-544815.

* cited by examiner

METHOD OF INTERSECTION IDENTIFICATION FOR COLLISION WARNING SYSTEM

BACKGROUND

The present invention relates generally to a motor vehicle, and in particular to a method for identifying an intersection for a collision warning system.

Collision warning systems are used to provide information to a driver regarding potential hazards or collisions. Current systems use navigation information to determine intersection locations. Potential threats to a driver upon approaching the intersections are determined by the collision warning system.

Systems in the related art are capable of determining potential threats at large intersections between two or more major roadways. However, the current systems lack provisions for identifying potential threats at many different possible types of intersections. Therefore, there exists a need in the art for a method that addresses the shortcomings of the related art.

SUMMARY

The invention discloses a method of identifying an intersection. The invention can be used in connection with a motor vehicle. The term "motor vehicle" as used throughout the specification and claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy. For example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides a method of operating a motor vehicle, comprising the steps of: receiving intersection information; retrieving a predetermined distance; determining a set of potential intersections from the intersection information, the set of potential intersections including all the intersections that are less than the predetermined distance in front of the motor vehicle; selecting an identified intersection from the set of potential intersections; determining a threat level according to the identified intersection; and controlling a collision warning system of the motor vehicle according to the threat level.

In one aspect, the invention provides a method of operating a motor vehicle, comprising the steps of: receiving intersection information; determining a vehicle speed; determining at least one potential intersection; determining a distance from the motor vehicle to the at least one potential intersection; retrieving a threshold speed and a threshold distance; setting the potential intersection as an identified intersection when the vehicle speed is below the threshold speed and when the distance is below the threshold distance; and controlling a collision warning system of the motor vehicle according to the identified intersection.

In another aspect, the invention provides a method of operating a motor vehicle, comprising the steps of: receiving intersection information; determining an identified intersection and a next intersection from a set of potential intersections, the next intersection being further in front of the motor vehicle than the identified intersection; determining if there is a stopped leading vehicle at the next intersection; controlling a collision warning system of the motor vehicle in a normal alert mode when there is a stopped leading vehicle at the next intersection; controlling the collision warning system in an enhanced alert mode when there is not a stopped leading vehicle at the next intersection; and where the enhanced alert mode is different than the normal alert mode.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
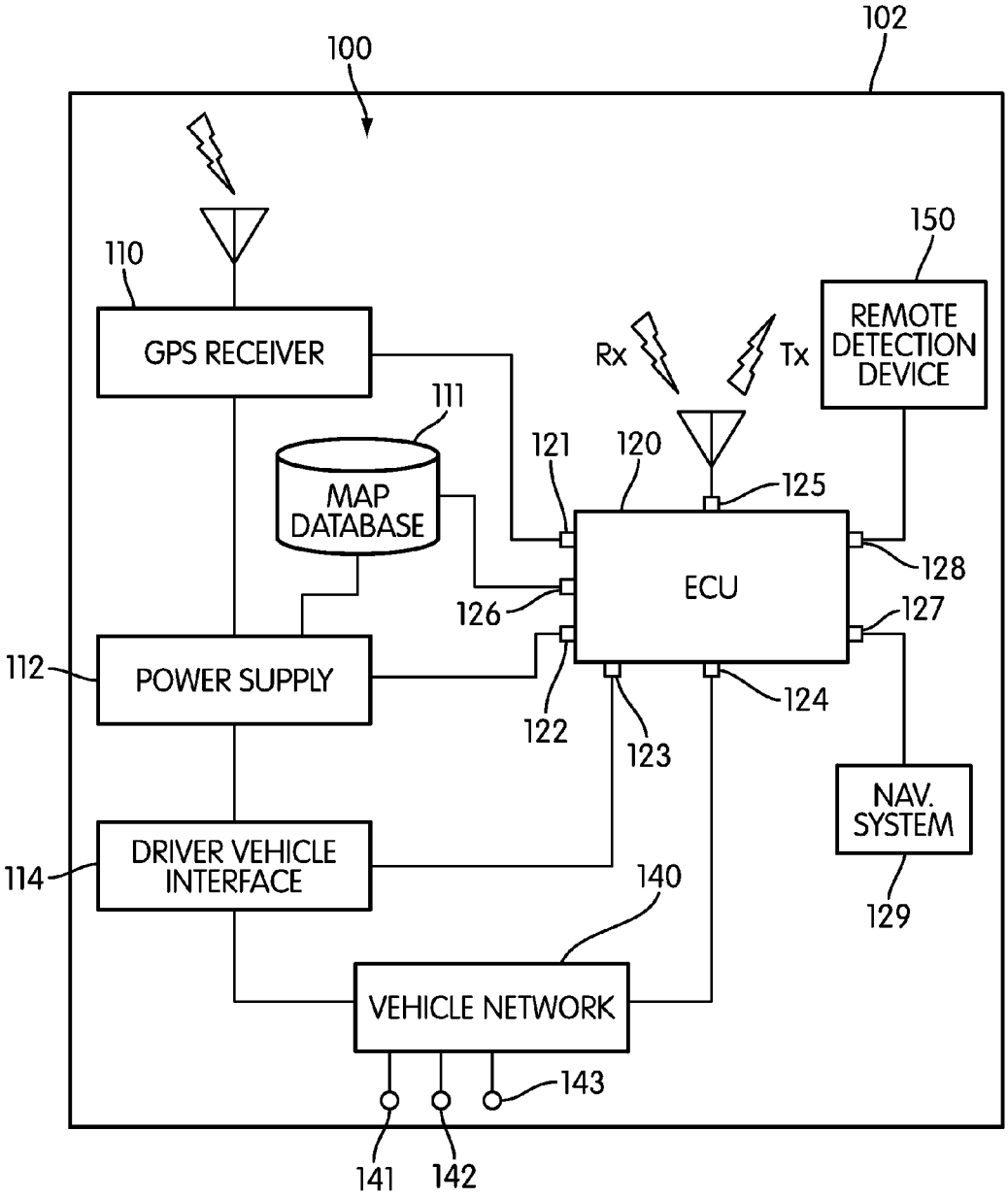
FIG. 1 is a schematic view of an embodiment of a motor vehicle including a collision warning system.

FIG. 1 is a schematic view of an embodiment of collision warning system 100 that is configured to be used within motor vehicle 102. Collision warning system 100 may be a system configured to detect potential collisions as well as to alert a driver or passenger to potential collisions. For purposes of clarity, only some components of a motor vehicle that may be relevant to collision warning system 100 are illustrated. Furthermore, in other embodiments, additional components can be added or removed.

Collision warning system 100 can include provisions for receiving navigation information. The term "navigation information" refers to any information that can be used to assist in determining a location or providing directions to a location. Some examples of navigation information include street addresses, street names, street or address numbers, apartment or suite numbers, intersection information, points of interest, parks, any political or geographical subdivision including town, township, province, prefecture, city, state, district, ZIP or postal code, and country. Navigation information can also include commercial information including business and restaurant names, commercial districts, shopping centers, and parking facilities. Navigation information can also include geographical information, including information obtained from any Global Navigational Satellite System (GNSS), including Global Positioning System or Satellite (GPS), Glonass (Russian) and/or Galileo (European). The term "GPS" is used to denote any global navigational satellite system. Navigation information can include one item of information, as well as a combination of several items of information.

Collision warning system 100 can include provisions for receiving GPS information. In some cases, collision warning system 100 can include GPS receiver 110. In an exemplary embodiment, GPS receiver 110 can be used for gathering GPS information for any systems of a motor vehicle, including, but not limited to: GPS based navigation systems.

In some embodiments, collision warning system 100 can be associated with a navigation system. In one embodiment, collision warning system 100 can be associated with navigation system 129. Generally, navigation system 129 can be any type of navigation system known in the art that is capable of using GPS based information to indicate a location for a vehicle and/or to plot routes for a driver. In some cases, a navigation system may be associated with mapping information that provides any of the GPS type information discussed above. In an exemplary embodiment, a navigation system can include roadway information as well as intersection information related to the intersections of two or more roadways.

Collision warning system 100 can include provisions for receiving additional navigation information. In some embodiments, collision warning system 100 can include map database 111. In some cases, map database 111 may be an onboard database configured to store various types of navigation information. In other cases, however, map database 111 may be a remote database that is accessed using one or more wireless networks.

In some embodiments, map database 111 may be configured to store roadway and intersection information. In an exemplary embodiment, map database 111 may be configured to store detailed road level entrance/exit information, including, but not limited to: driveway location information, parking lot entrance ramp and/or exit ramp information, as well as any other type of detailed road level information. For example, map database 111 may be configured to store information for commercial parking lot entrances or exits, whose locations are not typically stored in some GPS based navigation systems. As another example, map database 111 may be configured to store information for residential driveways, whose locations are also not typically stored in some GPS based navigations systems. Using map database 111, additional road level information can be provided to a collision warning system for purposes of determining the locations of various roadway features such as intersection locations.

Collision warning system 100 can include provisions for powering one or more devices. In some cases, collision warning system 100 can include power supply 112. Generally, power supply 112 can be any type of power supply associated with a motor vehicle. In some cases, power supply 112 can be a car battery. In other cases, power supply 112 can be another type of power supply available within motor vehicle 102. Although power supply 112 is shown as connected to some components of motor vehicle 102 in the current embodiment, it will be understood that in other embodiment additional components can be connected to power supply 112. In still other cases, some components that are shown as connected to power supply 112 may not be connected to power supply 112.

Collision warning system 100 can include provisions for communicating with a driver. In some embodiments, collision warning system 100 can include driver vehicle interface 114. In some cases, driver vehicle interface 114 can include provisions for transmitting information to a driver and/or passenger. In other cases, driver vehicle interface 114 can include provisions for receiving information from a driver and/or passenger. In an exemplary embodiment, driver vehicle interface 114 can include provisions for transmitting and receiving information from a driver and/or passenger. It will be further understood that in some embodiments, a driver vehicle interface can be associated directly with a navigation system of a motor vehicle. In other words, in some embodiment, a driver vehicle interface can be combined, or integrated into, a navigation system. With this arrangement, information communicated between a driver and a collision warning system can be accomplished using an interface of a navigation system.

Vehicle safety system 100 can include provisions for determining the range and/or speed of another vehicle or object. In some embodiments, vehicle safety system 100 can include a remote detection device. Examples of remote detection devices include, but are not limited to devices employing RADAR technology, devices employing LIDAR technology, as well as other types of remote sensing devices that are known in the art. In the exemplary embodiment, vehicle safety system 100 can be associated with remote detection device 150 that is disposed within motor vehicle 102.

Motor vehicle 102 may include provisions for communicating, and in some cases controlling, the various components associated with collision warning system 100. In some embodiments, collision warning system 100 may be associated with a computer or similar device. In the current embodiment, collision warning system 100 may include electronic control unit 120, hereby referred to as ECU 120. In one embodiment, ECU 120 may be configured to communicate with, and/or control, various components of collision warning system 100. In addition, in some embodiments, ECU 120 may be configured to control additional components of a motor vehicle that are not shown.

ECU 120 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 120 are optional. Some embodiments may include a given port or provision, while others may exclude it. The following description discloses many of the possible ports and provisions that can be used, however, it should be kept in mind that not every port or provision must be used or included in a given embodiment.

In some embodiments, ECU 120 can include port 121 for communicating with GPS receiver 110. In particular, ECU 120 may be configured to receive GPS information from GPS receiver 110. In addition, ECU 120 can include port 122 for receiving power from power supply 112. Also, ECU 120 can include port 123 for communicating with driver vehicle interface 114. In particular, ECU 120 can be configured to transmit information to driver vehicle interface 114, as well as to receive information from driver vehicle interface 114. Additionally, ECU 120 can include port 126 for communicating with map database 111. In particular, ECU 120 can be configured to access various types of navigation information stored within map database 111. Furthermore, in embodiments employing a remote detection device, ECU 120 can also include port 128 for communication with remote detection device 150. In embodiments where a driver vehicle interface for collision warning system 100 and navigation system 129 are distinct units, ECU 120 can also include port 127 for communicating with navigation system 129.

A collision warning system can include provisions for communicating with one or more vehicles using a vehicle communication network. The term "vehicle communication network" as used throughout this detailed description and in the claims refers to any network utilizing motor vehicles and roadside units as nodes. Vehicle communication networks may be used for exchanging various types of information between motor vehicles and/or roadside units. An example of such a vehicular network is a dedicated short range communication (DSRC) network. In some cases, DSRC networks may be configured to operate in the 5.9 GHz band with bandwidth of approximately 75 MHz. Furthermore, DSRC networks may have a range of approximately 1000 m.

In some embodiments, ECU 120 may include port 125 that is configured to communicate with one or more DSRC devices. In an exemplary embodiment, port 125 may be associated with a DSRC antenna that is configured to transmit and/or receive vehicle information over one or more vehicle communication networks.

Collision warning system 100 can include provisions for communicating with one or more components of a motor vehicle that are not associated directly, or indirectly with collision warning system 100. In some cases, ECU 120 may include additional ports for communicating directly with one or more additional devices of a motor vehicle, including various sensors or systems of the motor vehicle. In an exemplary embodiment, ECU 120 may include port 124 for communicating with vehicle network 140. By providing communication between ECU 120 and vehicle network 140, ECU 120 may have access to additional information concerning motor vehicle 102. For instance, in some cases, ECU 120 may be configured to receive information related to various operating conditions of a motor vehicle. Examples of information that may be received via vehicle network 140 include, but are not limited to: vehicle speed, engine speed, braking conditions, turning status, steering wheel angle, as well as other parameters associated with the operating condition of motor vehicle 102.

In some embodiments, information from various sensors and/or devices of motor vehicle 102 may be provided to ECU 120 through vehicle network 140. For example, in one embodiment, information from vehicle speed sensor 141, brake sensor 142 and turning status indicator 143 can be communicated to ECU 120 through vehicle network 140. In other cases, information from vehicle speed sensor 141, brake sensor 142 and turning indicator 143 can be communicated directly to ECU using wired or wireless connections, without being routed through vehicle network 140.

A collision warning system can include provisions for controlling one or more systems in a motor vehicle that may be utilized during a collision, or that can be used to help avoid a collision. For example, in some embodiments, ECU 120 may be configured to communicate with a brake actuator to help control braking prior to, or during a collision. In other embodiments, ECU 120 may be configured to communicate with an electric seat belt pre-tensioner to help control a seat belt during a collision. In still other embodiments, any systems of a motor vehicle can be controlled using ECU 120. In some embodiments, ECU 120 can be configured with additional ports for communicating with other systems of a motor vehicle, including systems used during a collision. In other embodiments, ECU 120 can be configured to communicate with these systems using a vehicle network. With this arrangement, a collision warning system can be configured to control one or more systems that may be used to help avoid a collision or to increase the safety of one or more occupants during a collision.

Figure 2:
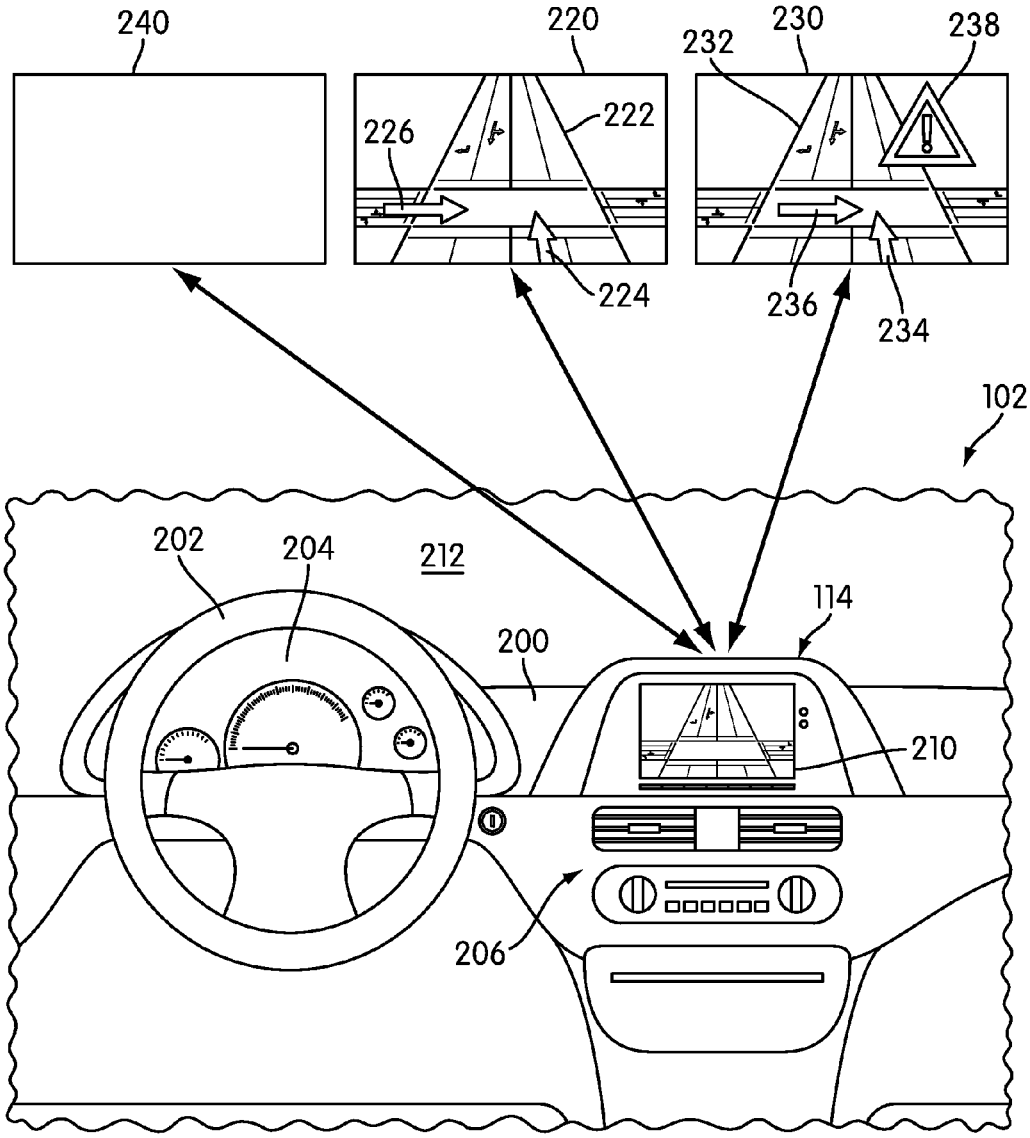
FIG. 2 is a schematic view of an embodiment of a driver vehicle interface for a collision warning system in a motor vehicle.

FIG. 2 illustrates an embodiment of dashboard 200 for motor vehicle 102. Dashboard 200 may include steering wheel 202 and instrument panel 204. In some embodiments, dashboard 200 can further include center portion 206. In some cases, center portion 206 can include one or more devices associated with an interior of a motor vehicle. Examples include, but are not limited to: audio devices, video devices, navigation devices, as well as any other types of devices. In addition, center portion 206 can be associated with controls for one or more systems of motor vehicle 102 including, but not limited to: climate control systems and other types of systems.

A motor vehicle can include provisions for displaying information from a collision warning system. In some embodiments, a motor vehicle can include a display device of some kind. In some cases, a motor vehicle can include a video screen for displaying information from a collision warning system. Examples of display devices include, but are not limited to: LCDs, CRTs, ELDs, LEDs, OLEDs, as well as other types of displays. In other cases, a display device could be a projection type display device that is configured to project an image onto one or more surfaces of motor vehicle 102. It will be understood that a display device may not be limited to a video screen or projection type display device.

In one embodiment, motor vehicle 102 can include display device 210. In some cases, display device 210 may be associated with driver vehicle interface 114 of collision warning system 100. In particular, display device 210 may be configured to present visual information received from collision warning system 100. In an exemplary embodiment, display device 210 may be an LCD screen.

In some embodiments, display device 210 can be disposed within center portion 206. However, it will be understood that in other embodiments, display device 210 can be located in any portion of motor vehicle 102 as long as display device 210 can be viewed by a driver. For example, in another embodiment, display device 210 may be a projection type device that displays an image onto front window 212. In addition, while display device 210 can be configured to present visual information received from collision warning system 100, display device 210 may be shared with other devices or systems within motor vehicle 102. For example, display device 210 could also be used as a screen for a navigation system.

It will be understood that in some embodiments, a driver vehicle interface can include additional provisions beyond a display screen. For example, in another embodiment, a driver vehicle interface can also be associated with one or more input devices that allow a driver to control various aspects of a collision warning system. In some cases, a driver vehicle interface can include an on/off button for turning a collision warning system on and off. In still another embodiment, a driver vehicle interface can be associated with speakers for generating auditory information.

A display device for a collision warning system can be configured to display one or more images associated with various types of alerts of the collision warning system. For purposes of clarity, the following detailed description discusses a collision warning system utilizing two distinct alert types: informing alerts and warning alerts. In particular, informing alerts are used to inform a driver of nearby vehicles or objects that could pose potential problems at a later time. In contrast, a warning alert may be issued to warn the driver of a serious threat of collision with a nearby vehicle or object. In other words, informing alerts inform a driver of low level collision threats, while warning alerts inform a driver of high level collision threats. In other embodiments, any other number of alert types can be used. In some cases, three or more alert types could be issued by a collision warning system.

In the exemplary embodiment, collision warning system 100 includes informing alert image 220 that is associated with an informational alert. Informing alert image 220 may comprise one or more symbols or icons. In this embodiment, informing alert image 220 includes intersection symbol 222, which indicates an upcoming intersection. In addition, informing alert image 220 includes first arrow 224 and second arrow 226, representing the general location and heading of motor vehicle 102 and an approaching vehicle for which there may some threat of collision. By displaying informing alert image 220, a driver is alerted to a potential collision threat with an approaching vehicle. This information may help a driver to be more aware as motor vehicle 102 approaches the upcoming intersection.

In the exemplary embodiment, collision warning system 100 also includes warning alert image 230 that is associated with a warning alert. Warning alert image 230 may comprise one or more symbols or icons. In a similar manner to informing alert image 220, warning alert image 230 may include intersection symbol 232, first arrow 234 and second arrow 236. These symbols indicate information about an upcoming intersection as well as the speeds and headings of motor vehicle 102 and an approaching vehicle. In addition, warning alert image 230 includes warning symbol 238. The appearance of warning symbol 238 alerts a driver to an immediate threat posed by an approaching vehicle. This information may help a driver to avoid a collision by taking immediate action.

In addition to the two types of alerts discussed above, a display device may be configured to display no image when no alert has been issued by collision warning system 100. In this embodiment, display device 210 displays default screen 240 when no alert is issued. In the exemplary embodiment, default screen 240 is associated with a blank screen of display device 210. However, in embodiments where display device 210 is used for displaying information from other systems, default screen 240 may not be a blank screen. For example, in embodiments where display device 210 is shared between a navigational system and collision warning system 100, display device 210 may continue to display images received from the navigation system until an alert is issued. Likewise, once an alert has expired, display device 240 may return to displaying images from a navigation system.

Although a single image is shown for each type of alert (informing alerts and warning alerts) in the current embodiment, other embodiments can include more than one image for each type of alert. In particular, an arrow used to indicate position and heading of a vehicle can be changed from a straight arrow indicating the intention of a vehicle to pass straight through an intersection to curved arrows in cases where the intention of the vehicle is to turn at the intersection. This arrangement can help to inform a driver as to the intentions of an approaching vehicle. In addition, a three way intersection symbol can be used in place of a four way intersection symbol in cases where the upcoming intersection is a three way intersection. However, in embodiments using multiple images for each type of alert, it will be understood that some distinguishing elements may be used to indicate that an alert is an informing alert or a warning alert. For example, as in the current embodiment, a warning symbol can be used to distinguish between informing alerts and warning alerts. Likewise, in some cases, informing alerts can be associated with a different color than warning alerts. In one embodiment, informing alerts can include symbols or icons colored in yellow, while warning alerts can include symbols or icons colored in red.

Figure 3:
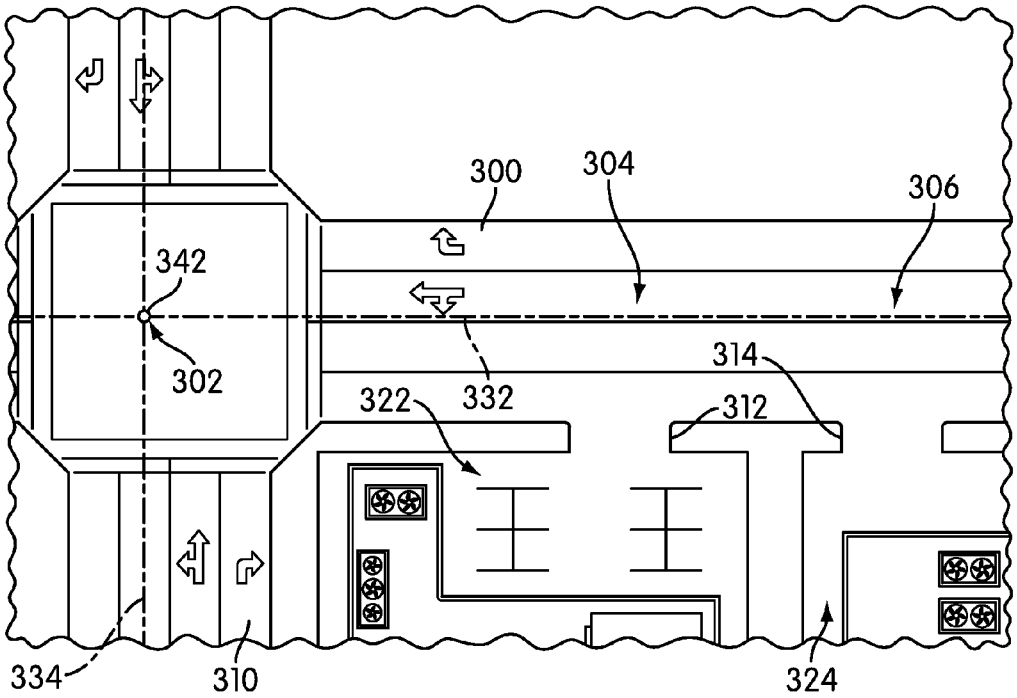
FIG. 3 is a schematic view of an embodiment of intersection information stored in a navigation system.
Figure 4:
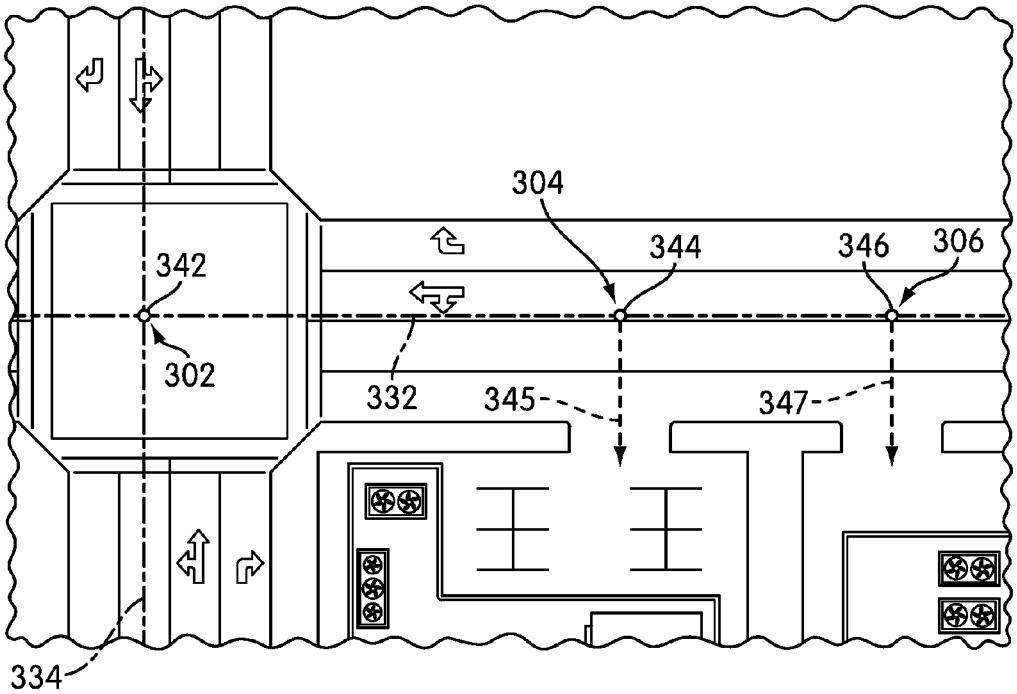
FIG. 4 is a schematic view of an embodiment of intersection information determined from a navigation system and an additional map database.

FIGS. 3 and 4 illustrate embodiments of a roadway and corresponding navigation information provided about the roadway. Referring to FIGS. 3 and 4, first roadway 300 is associated with first intersection 302. In this case, first intersection 302 may be a primary intersection. In particular, first roadway 300 intersects second roadway 310 at first intersection 302. Additionally, first roadway 300 includes second intersection 304 and third intersection 306, which are associated with smaller driveways for commercial lots that are located along first roadway 300. Second intersection 304 is associated with first driveway 312 and third intersection 306 is associated with second driveway 314. In one embodiment, first driveway 312 may provide access to first parking lot 322 of a commercial lot. Likewise, second driveway 314 may provide access to second parking lot 324 of a commercial lot. In other embodiments, it will be understood, first driveway 312 and/or second driveway 314 could provide access to residential lots. In still other embodiments, first driveway 312 and/or second driveway 314 could provide access to secondary roadways such as access roads.

Current navigation systems may provide information about roadways. However, in many situations, intersection information may be limited to intersections of two or more roadways. In particular, current navigation systems may not include intersection information related to various driveways or entrance/exit ramps to residential and/or commercial lots. For example, referring to FIG. 3, which shows navigation information that may be provided by a typical GPS based navigation system, the locations of first roadway 300 and second roadway 310 may be stored as first link 332 and second link 334, respectively. In addition, the location of first intersection 302 may be stored as first node 342.

In contrast, the current embodiment includes provisions for storing additional intersection information. For example, referring to FIG. 4, in one embodiment, the locations of second intersection 304 and third intersection 306 are stored as second node 344 and third node 346. Furthermore, the locations of first roadway 300, second roadway 310 and first intersection 302 are also stored as first link 332, second link 334 and first node 342. With this arrangement, the locations of all three intersections associated with first roadway 300 can be stored and used for controlling a collision warning system.

In some embodiments, each node representing the location of an intersection, may be further associated with exit information that indicates possible directions for exiting the intersection. For example, in the current embodiment, second node 344, which represents the location of second intersection 304, may be further associated with exit information. In other words, second node 344 is associated with additional information indicating an exit direction. In the current embodiment, second node 344 is associated with first exit indicator 345. In a similar manner, third node 346 is associated with second exit indicator 347. With this additional exit information, a collision warning system may determine that a vehicle traveling on first roadway 300 towards first intersection 302 has the option to turn left at second intersection 304 or third intersection 306. Likewise, a vehicle traveling on first roadway 300 away from first intersection 302 has the option to turn right at second intersection 304 or third intersection 306. By providing exit information in addition to the location of an intersection, the ability of the collision warning system to properly alert a driver of possible dangers at an intersection can be enhanced.

In some embodiments, various types of intersection information can be associated with different components of a motor vehicle. For example, in one embodiment, a navigation system may be configured to store primary intersection information. The term "primary intersection information" refers to information regarding intersections between two or more roadways associated with a predetermined level of mapping detail. Likewise, in one embodiment, an additional map database, such as a digital map database, may be configured to store secondary intersection information. The term "secondary intersection information" refers to intersections associated with various driveways, exits, entrances, or other smaller roadways that are not categorized as primary intersection information and which may be associated with a higher level of mapping detail. In some cases, the secondary intersection information can include the locations of intersections that are uncharted in typical GPS based navigation systems. In other embodiments, however, the intersection information can be stored in a single location, such as a navigation system or in a separate digital map database.

In the embodiments shown in FIGS. 3 and 4, for example, first intersection 302 may be considered a primary intersection. In addition, second intersection 304 and third intersection 306 may be considered secondary intersections. In some embodiments, first intersection 302 may be stored in a traditional GPS based navigation system, while second intersection 304 and third intersection 306 may be stored in a separate map database. However, in other embodiments, no distinction may be made between different types of intersections and all intersection information could be stored in a single database or within the memory of a single component of a motor vehicle.

Throughout this detailed description and in the claims, it will be understood that a collision warning system can include provisions for determining when a driver intends to turn left. In some cases, the collision warning system can receive information related to the turning indicator status (i.e., the state of a blinker). In other cases, the collision warning system can receive information related to a turning lane used by the motor vehicle. For example, if the motor vehicle is determined to be traveling on a left turning lane as the motor vehicle approaches an intersection, the collision warning system may determine that the driver intends to turn left at the intersection.

When a driver has an intention of turning left across oncoming traffic, a collision warning system may be configured to inform or warn a driver about potential collisions with oncoming traffic. However, in situations where several intersections are nearby, the collision warning system may have difficulty identifying where the driver intends to turn. For example, some roadways may include a large number of residential or commercial driveways that are located close together. In these cases, failing to identify the intersection where the driver intends to turn can reduce the effectiveness of a collision warning system.

In order to increase the effectiveness of a collision warning system, a motor vehicle can include provisions for identifying an intersection where a driver intends to turn. In some cases, a collision warning system can identify a set of potential intersections where a driver could possibly turn. Furthermore, a collision warning system can select an identified intersection from the set of potential intersections according to various operating parameters of the motor vehicle.

Figure 5:
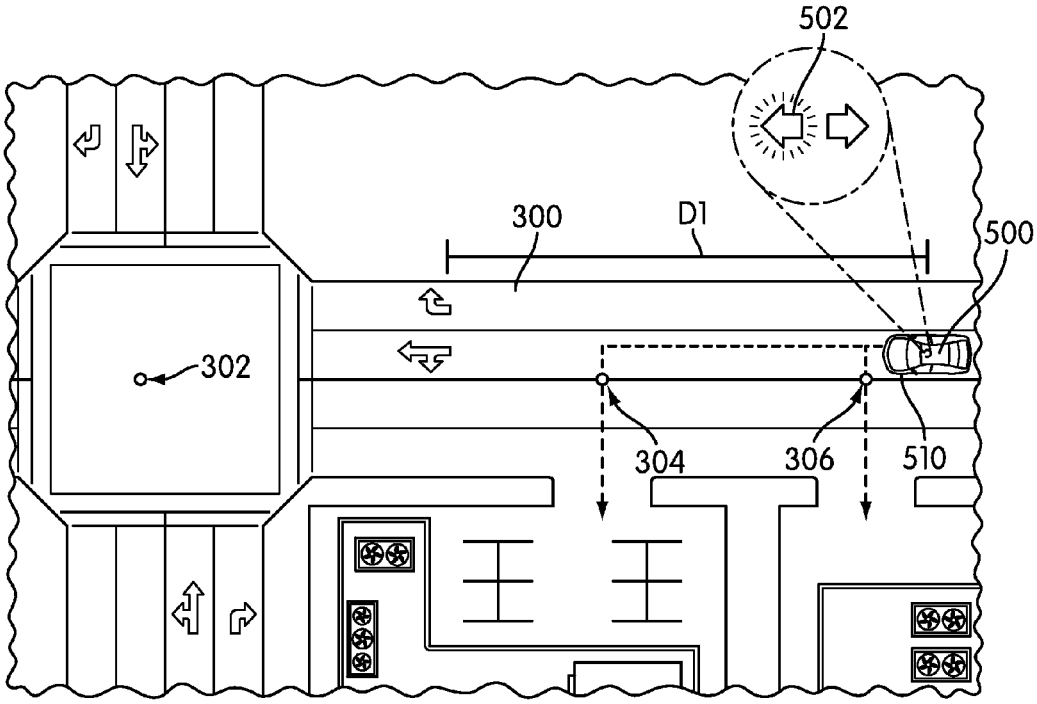
FIG. 5 is a schematic view of an embodiment of a method for determining a set of potential intersections.
Figure 6:
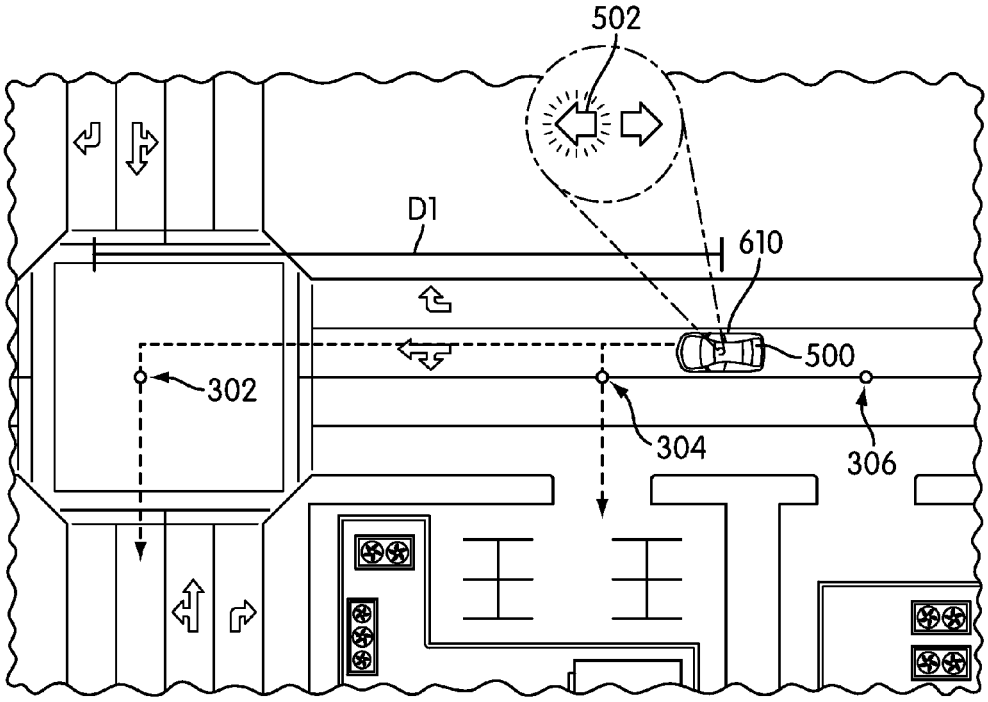
FIG. 6 is a schematic view of an embodiment of a method for determining a set of potential intersections.

FIGS. 5 and 6 illustrate embodiments of a method of identifying a set of potential intersections. Referring to FIGS. 5 and 6, motor vehicle 500 is traveling on first roadway 300. In this case, motor vehicle 500 is traveling towards first intersection 302. As discussed above, first roadway 300 is further associated with second intersection 304 and third intersection 306.

In this case, a driver of motor vehicle 500 intends to turn left, as indicated by left turning indicator 502. Once the collision warning system receives an indication that the driver intends to turn left, the collision warning system may determine a set of potential intersections from the available intersection information. In one embodiment, the collision warning system can use a predetermined distance to determine a set of potential intersection. In other embodiments, however, a set of potential intersections can be determined in another manner.

Referring to FIG. 5, motor vehicle 500 is initially located at first position 510. In this position, first intersection 302, second intersection 304 and third intersection 306 are all located ahead of motor vehicle 500 with respect to the traveling direction. While motor vehicle is located at first position 510, the collision warning system may determine which intersections are located a predetermined distance in front of, or ahead of, motor vehicle 500.

In the current embodiment, predetermined distance D1 may be used for determining a set of potential intersections. Generally, the value of predetermined distance D1 may vary. In some cases, predetermined distance D1 can have a value between 0 and 5 meters. In other cases, predetermined distance D1 can have a value between 5 and 500 meters. In still other cases, predetermined distance D1 can have a value greater than 500 meters. For example, if a manufacturer determines that a typical driver will not activate a turning signal until they are within 20 meters of an intersection, predetermined distance D1 can be selected to have a value in the range between 20 and 30 meters. However, in other embodiments, predetermine distance D1 can be selected according to any other criteria.

With motor vehicle 500 located at first position 510, the collision warning system may determine that second intersection 304 and third intersection 306 are located within predetermined distance D1 of motor vehicle 500. More specifically, second intersection 304 and third intersection 306 may be located ahead of motor vehicle 500 within predetermined distance D1. In other words, the collision warning system may not consider intersections located behind motor vehicle 500, since a driver does not likely intend to turn at any intersections located behind motor vehicle 500. At this point, the collision warning system can determine that the set of potential intersections comprises second intersection 304 and third intersection 306. Furthermore, in this case, first intersection 302 is not included in the set of potential intersections, since first intersection 302 is located further from motor vehicle 500 than predetermined distance D1.

Referring to FIG. 6, as motor vehicle 500 continues to move forwards, the collision warning system may continuously update the set of potential intersections. After passing third intersection 306, the collision warning system may determine that third intersection 306 is no longer included in the set of potential intersections. Furthermore, as motor vehicle 500 reaches second position 610, the collision warning system may determine that first intersection 302 is now within predetermined distance D1 of motor vehicle 500. Therefore, with motor vehicle 500 located at second position 610 the set of potential intersections includes first intersection 302 and second intersection 304.

As previously discussed, the collision warning system can be provided with intersection information from any sources. In some cases, the collision warning system can receive intersection information from a navigation system. In other cases, a collision warning system can receive intersection information from an onboard map database. In still other cases, a collision warning system can receive intersection information from a remote map database. Still further, in other cases, the collision warning system may receive intersection information from remote vehicles or roadside equipment using a wireless network, such as a DSRC network. It will also be understood that in some embodiments a collision warning system can receive intersection information from a combination of different sources.

Figure 7:
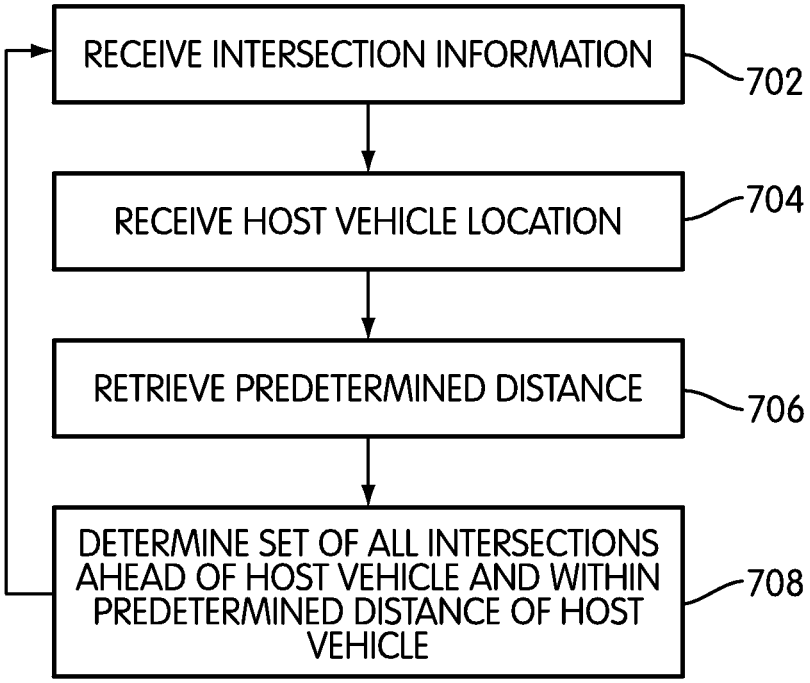
FIG. 7 is an embodiment of a process for determining a set of potential intersections.

FIG. 7 illustrates an embodiment of a method of determining a set of potential intersections. In this embodiment, the following steps may be performed by ECU 120; however in some embodiments these steps may be performed by additional systems or devices associated with motor vehicle 500. In addition, it will be understood that in other embodiments one or more of the following steps may be optional.

For purposes of distinguishing between different vehicles, the terms host vehicle and remote vehicle are used throughout this detailed description and in the claims. The term "host vehicle" refers to a vehicle with a collision warning system. In contrast, a "remote vehicle" is any other vehicle about which the host vehicle may receive information. In some cases, the host vehicle may communicate with the remote vehicle using a vehicle communication network. In other cases, the host vehicle can receive information from the remote vehicle using other methods. For example, the host vehicle can receive a relative location for a remote vehicle using a remote detection device. A remote vehicle may or may not have a collision warning system. In the examples given above, motor vehicle 500 is a host vehicle that is capable of communicating with one or more remote vehicles. It will be understood that the term host vehicle is a relative term, and that other vehicles may have collision warning systems and may be considered host vehicles in different contexts.

During step 702, ECU 120 may receive intersection information. In some cases, the intersection information can be received from a navigation system. In other cases, the intersection information can be received from an additional map database. In still other cases, the intersection information can be received from both the navigation system and the additional map database. In other cases, the intersection information can be received by any other sources.

Next, during step 704, ECU 120 may receive the host vehicle location. In some cases, ECU 120 may receive information related to the host vehicle location from a GPS receiver. Following this, during step 706, ECU 120 may retrieve a predetermined distance. Next, during step 708, ECU 120 may determine the set of potential intersections as all the intersections ahead of the host vehicle and within the predetermined distance of the host vehicle. Finally, following step 708, ECU 120 may return to step 702 to receive updated intersection information as the motor vehicle continues to travel on a particular route.

Once a set of possible intersections has been determined, the collision warning system can proceed to identify one intersection from the set of potential intersections that corresponds to the intersection where the driver intends to turn. In some cases, the collision warning system can identify the intended intersection according to one or more operating parameters of a motor vehicle. Since a driver may slow down upon approaching the intended intersection, the collision warning system can identify the intended intersection when the vehicle is slowing down near one of the potential intersections. In other words, when the vehicle speed is below a threshold speed and when the vehicle is located within a threshold distance from one of the potential intersections.

Figure 8:
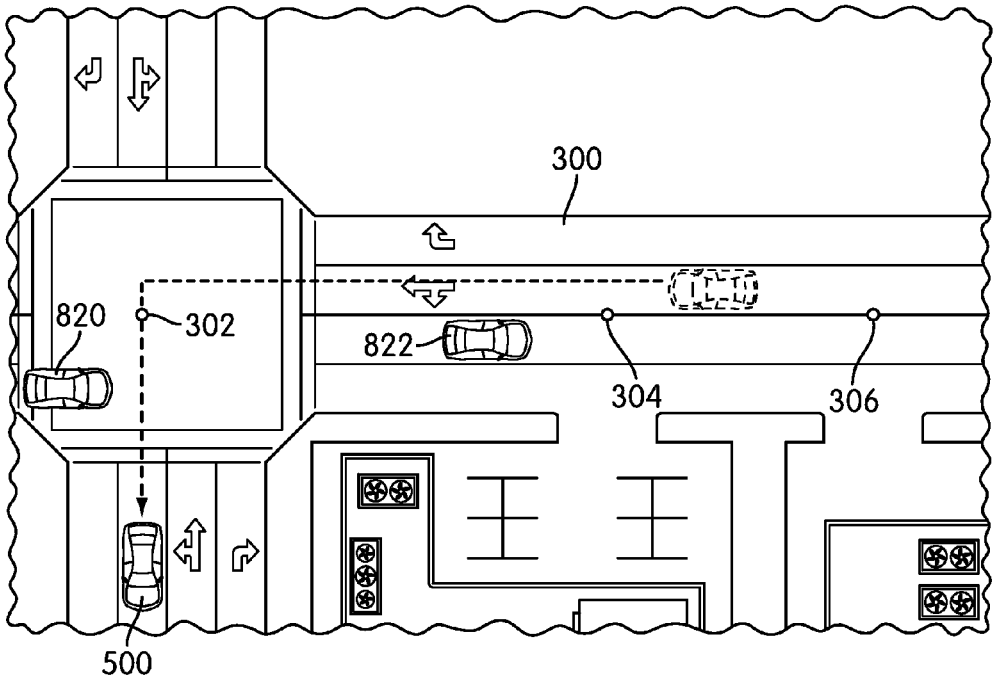
FIG. 8 is a schematic view of an embodiment of a method for identifying an intersection from a set of potential intersections.
Figure 9:
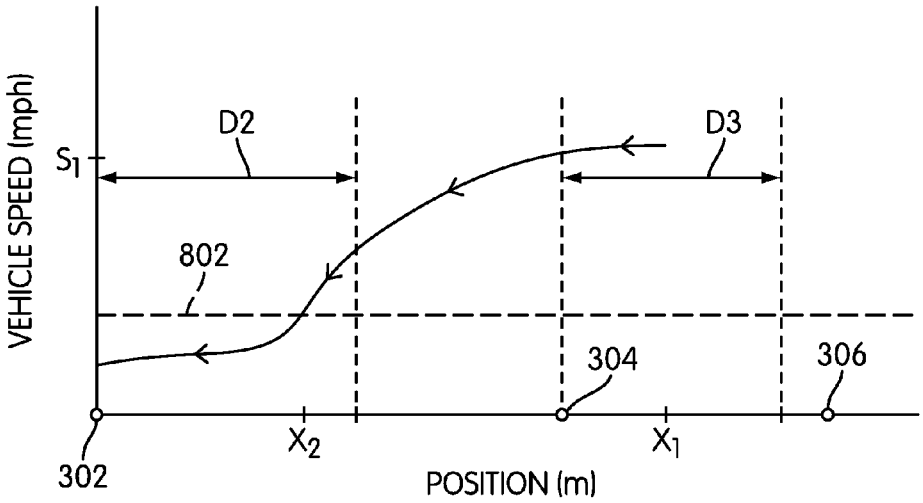
FIG. 9 is schematic view of an embodiment of a method for identifying an intersection from a set of potential intersections.

FIG. 8 through 11 illustrate two possible scenarios for intersection identification. Referring to FIGS. 8 and 9, motor vehicle 500 may travel on first roadway 300 with the intention of turning left at first intersection 302. In addition, first remote vehicle 820 and second remote vehicle 822 may be traveling in opposing lanes on first roadway 300. In particular, first remote vehicle 820 may be traveling through first intersection 302, while second remote vehicle 822 may be traveling through second intersection 304. In this case, since the driver intends to turn left at first intersection 302, there is some chance that motor vehicle 500 could collide with first remote vehicle 820. On the other hand, since the driver does not intend to turn left at second intersection 304, there is no chance of collision between motor vehicle 500 and second remote vehicle 822. Therefore, the collision warning system may be configured to provide alerts to the driver of motor vehicle 500 as motor vehicle 500 approaches first intersection 302. Also, the collision warning system may not issue any alerts to the driver of motor vehicle 500 as motor vehicle 500 approaches second intersection 304 to avoid annoying the driver with unnecessary information.

As previously discussed, the collision warning system may continuously update the set of potential intersections. In this case, the set of potential intersections comprises first intersection 302 and second intersection 304. In some embodiments, the collision warning system may also be configured to monitor the vehicle speed and position of motor vehicle 500. The collision warning system can be configured to compare the speed of motor vehicle 500 with a predetermined value. In the current embodiment, the collision warning system may compare the vehicle speed with speed threshold 802. In addition, the collision warning system can be configured to check if motor vehicle 500 is located within a threshold distance of any potential intersections. In the current embodiment, the collision warning system may check to see if motor vehicle 500 is located within first threshold distance D2 from first intersection 302. Also, the collision warning system may check to see if motor vehicle 500 is located within second threshold distance D3 from second intersection 304. With this arrangement, the collision warning system may determine an identified intersection from a set of potential intersections whenever the velocity of motor vehicle 500 is below speed threshold 802 and whenever motor vehicle 500 is within a threshold distance from a potential intersection.

In some embodiments, first threshold distance D2 and second threshold distance D3 may have substantially equal values. Furthermore, in some cases, the threshold distance may be substantially similar for all potential intersections. In other embodiments, however first threshold distance D2 and second threshold distance D3 can be substantially different values. In some cases, the value of a threshold distance can be selected according to the type of intersection. For example, in one embodiment, a first threshold distance associated with a large intersection can have a larger value than a second threshold distance associated with a small intersection.

In the embodiment illustrated in FIGS. 8 and 9, at position X1, motor vehicle 500 is traveling at speed 51. At this point, motor vehicle 500 is located within second threshold distance D3 of second intersection 304. However, because speed 51 is above speed threshold 802 the collision warning system does not select second intersection 304 as the identified intersection.

As motor vehicle 500 approaches first intersection 302, motor vehicle 500 may begin to slow down. Eventually, motor vehicle 500 may slow down to a speed that is less than speed threshold 802 at position X2. In addition, position X2 is within first threshold distance D2 of first intersection 302. Therefore, the collision warning system may determine that first intersection 302 is the identified intersection and control the collision warning system accordingly.

Figure 10:
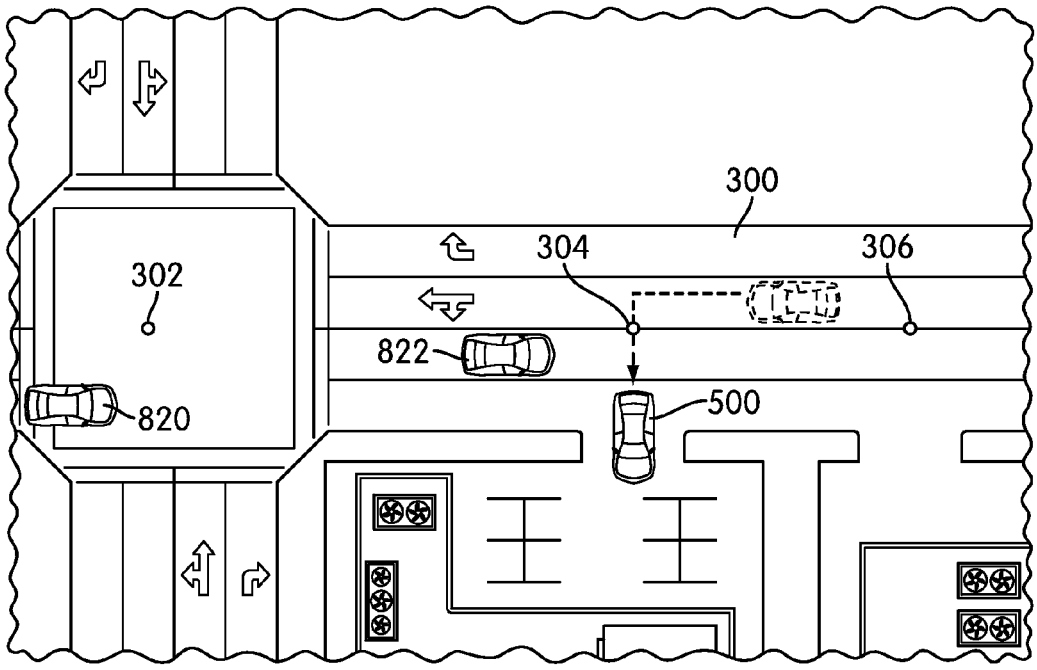
FIG. 10 is a schematic view of an embodiment of a method for identifying an intersection from a set of potential intersections.
Figure 11:
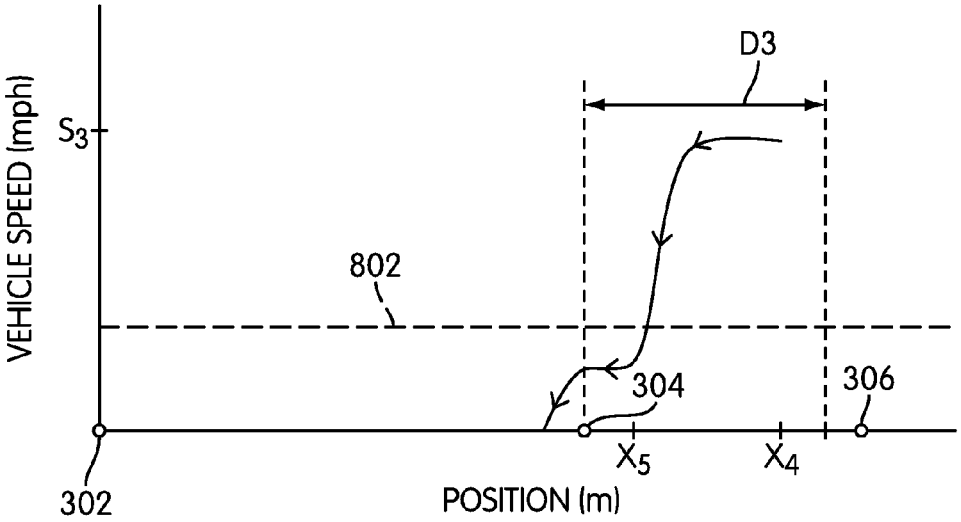
FIG. 11 is a schematic view of an embodiment of a method for identifying an intersection from a set of potential intersections.

In another scenario, illustrated in FIGS. 10 and 11, the diver of motor vehicle 500 intends to turn left at second intersection 304. In this situation, second remote vehicle 822 poses a potential threat to motor vehicle 500, while first remote vehicle 820 poses no threat to motor vehicle 500. Therefore, the collision warning system may be configured to provide alerts to the driver of motor vehicle 500 as motor vehicle 500 approaches second intersection 304.

In this case, at position X4, motor vehicle 500 is traveling at speed S3. As motor vehicle 500 approaches second intersection 304, motor vehicle 500 may begin to slow down. Eventually, motor vehicle 500 may slow down to a speed that is less than speed threshold 802 at position X5. In addition, position X5 is within second threshold distance D3 of second intersection 304. Therefore, the collision warning system may determine that second intersection 304 is the identified intersection and control the collision warning system accordingly.

Figure 12:
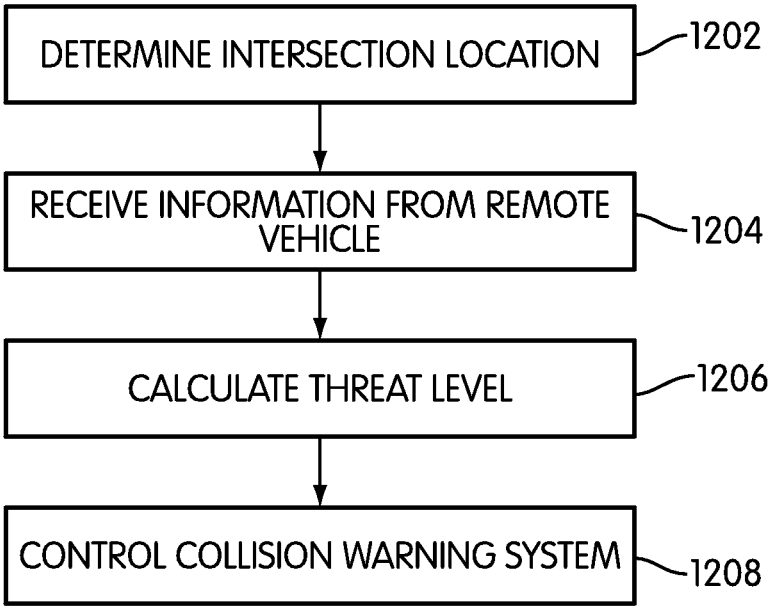
FIG. 12 is an embodiment of a process for controlling a collision warning system.

FIG. 12 illustrates an embodiment of a detailed process for controlling a collision warning system. In this embodiment, the following steps may be performed by ECU 120; however in some embodiments these steps may be performed by additional systems or devices associated with motor vehicle 500. In addition, it will be understood that in other embodiments one or more of the following steps may be optional.

During step 1202, ECU 120 may determine the location of an intersection where a driver intends to turn. Next, during step 1204, ECU 120 may be configured to receive information from a remote vehicle. In some embodiments, information related to the remote vehicle can be received using a vehicle communication network. In some cases, the information can include the heading, position and speed of the remote vehicle. In other cases, additional information such as basic safety messages can also be received. In still other cases, other operating parameters of the remote vehicle can be received. Furthermore, in embodiments where the host vehicle and the remote vehicle may not be in communication using a vehicle communication network, information related to the remote vehicle can be measured using a remote detection device. For example, a LIDAR or RADAR can be used to determine the distance to a remote vehicle, or the speed of the remote vehicle.

Following step 1204, during step 1206, ECU 120 may be configured to calculate a threat level for the motor vehicle. In some cases, the threat levels may comprise "no threat," "low threat," and "high threat" as discussed above. In other cases, however, additional threat levels could be used. In still other cases, only two distinct threat levels may be used. Next, during step 1208, ECU 120 may be control the collision warning system according to the determined threat level in the manner discussed above and illustrated in FIG. 2.

Figure 13:
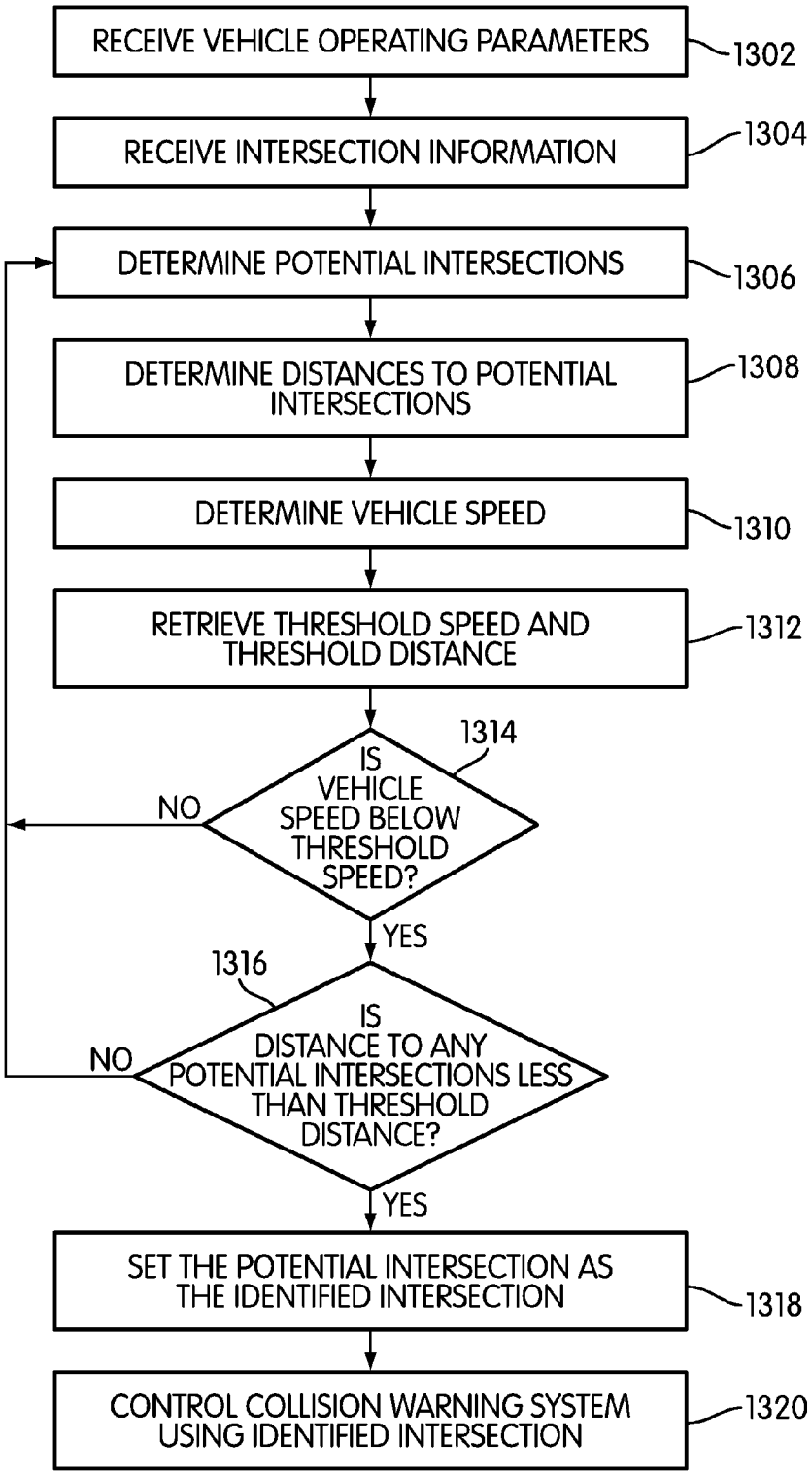
FIG. 13 is an embodiment of a detailed process for identifying an intersection.

FIG. 13 illustrates an embodiment of a detailed process for identifying an intersection from a set of potential intersections. In this embodiment, the following steps may be performed by ECU 120; however in some embodiments these steps may be performed by additional systems or devices associated with motor vehicle 500. In addition, it will be understood that in other embodiments one or more of the following steps may be optional.

During step 1302, ECU 120 may receive one or more operating parameters of motor vehicle 500. In some embodiments, ECU 120 can be configured to receive information related to the position and the speed of the vehicle. In other embodiments, however, additional parameters may also be received. Next, during step 1304, ECU 120 may be configured to receive intersection information. In some cases, the intersection information can be received from a navigation system. In other cases, the intersection information can be received from an additional map database. In still other cases, the intersection information can be received from both the navigation system and the additional map database.

Following step 1304, during step 1306, ECU 120 may be configured to determine a set of potential intersections. In some embodiments, the set of potential intersections can be determined by selecting the intersections that are within a predetermined distance ahead of motor vehicle 500. Next, during step 1308, ECU 120 can determine the distances to the potential intersections. In other words, ECU 120 can determine a set of distances, where each distance in the set corresponds to the distance between motor vehicle 500 and one of the potential intersections. Next, during step 1310, ECU 120 can determine the vehicle speed according to the vehicle operating parameters received during step 1302. Following this, during step 1312 ECU 120 can retrieve a threshold speed and a threshold distance.

After step 1312, ECU 120 may proceed to step 1314. During step 1314, ECU 120 may determine if the vehicle speed is below the threshold speed. If so, ECU 120 may proceed to step 1316. Otherwise, ECU 120 may return to step 1306 to determine the set of potential intersections again.

During step 1316, ECU 120 may determine if the distance to any potential intersection is less than the threshold distance. In other words, ECU 120 may determine if motor vehicle 500 is located within the threshold distance of any of the potential intersections. If so, ECU 120 may proceed to step 1318. Otherwise, ECU 120 may proceed back to step 1306. During step 1318, ECU 120 may set the potential intersection that is located within the threshold distance to motor vehicle 500 as the identified intersection. Following this, during step 1320, ECU 120 may control the collision warning system using the identified intersection.

Figure 14:
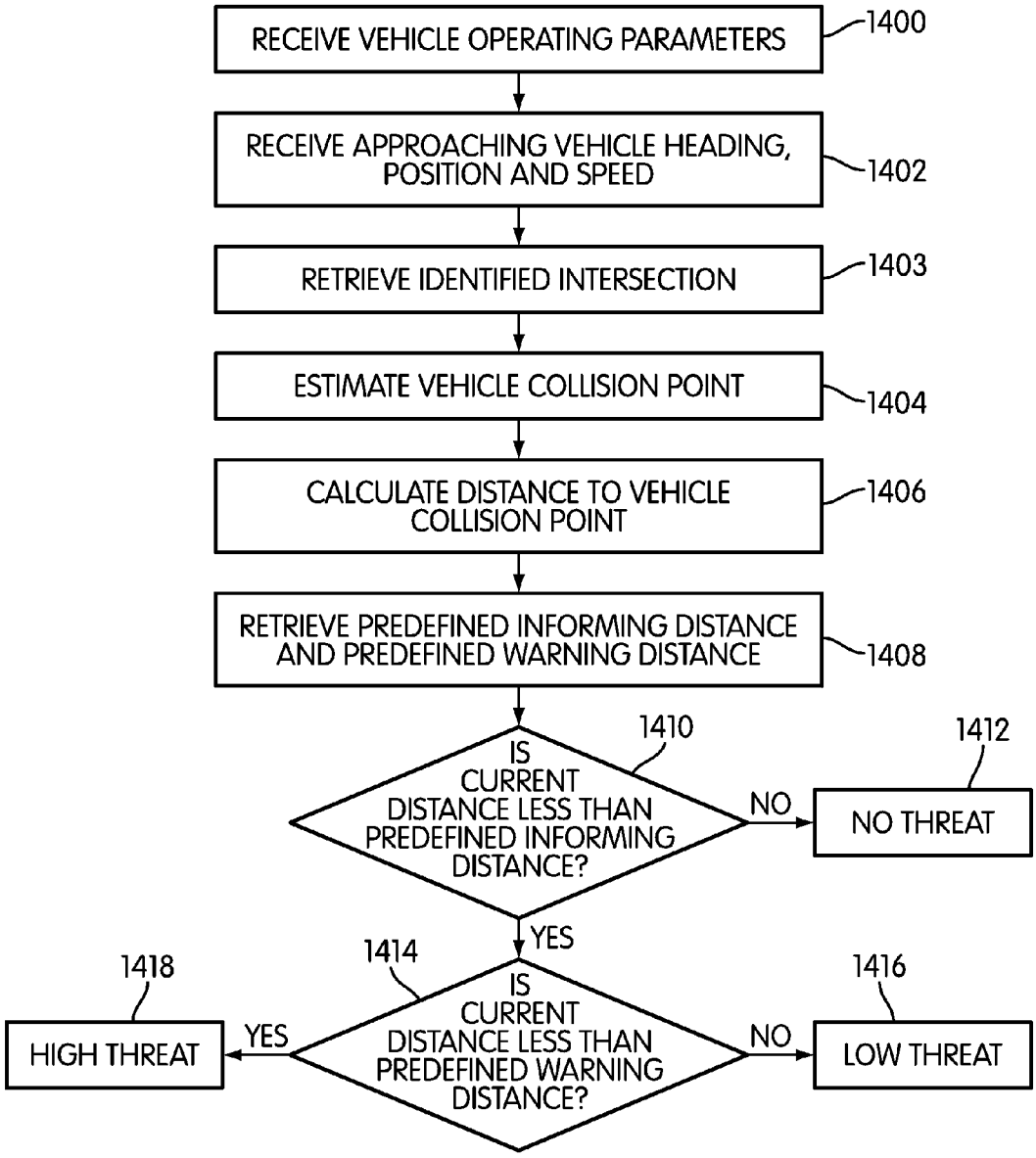
FIG. 14 is an embodiment of a detailed process for calculating a threat level for a collision warning system.

FIG. 14 illustrates an embodiment of a detailed process for calculating a threat level. In this embodiment, the following steps may be performed by ECU 120; however in some embodiments these steps may be performed by additional systems or devices associated with motor vehicle 500. In addition, it will be understood that in other embodiments one or more of the following steps may be optional.

During step 1400, ECU 120 can receive the vehicle operating parameters associated with motor vehicle 500. In some cases, the vehicle operating parameters can include the position, heading and speed, as well as other operating parameters. Next, during step 1402, ECU 120 can retrieve the heading, position and speed of an approaching vehicle, which is a remote vehicle in an oncoming traffic lane, using a vehicle communication network. Following step 1402, during step 1403, ECU 120 can retrieve the identified intersection that has been determined during step 1202 above.

Next, during step 1404, ECU 120 may estimate a vehicle collision point. The term "vehicle collision point" refers to a point at which the motor vehicle and the remote vehicle would collide given current headings, positions and speeds for both vehicles. In addition, ECU 120 may use other available information for estimating a vehicle collision point, such as the intention of one or both drivers to turn at an upcoming intersection.

Following step 1404, ECU 120 may proceed to step 1406. During step 1406, ECU 120 may calculate the distance to the vehicle collision point. In some cases, the vehicle collision point may be estimated a point within the identified intersection where motor vehicle 500 may collide with the remote or approaching vehicle. In one embodiment, this collision point can be estimated using the headings, speeds and positions of both motor vehicle 500 and the remote vehicle. In other embodiments, however, the collision point may be estimated as the center of the identified intersection, or some other predetermined location within the identified intersection.

At this point, ECU 120 may proceed to step 1408. During step 1408, ECU 120 retrieves a predefined informing distance and a predefined warning distance. In other words, the predefined informing distance is a distance from the vehicle collision point within which the collision warning system may determine that there is a low threat of collision. Likewise, the predefined warning distance is a distance from the vehicle collision point within which the collision warning system may determine that there is a high threat of collision.

Following step 1408, ECU 120 may proceed to step 1410. During step 1410, ECU 120 may determine if the current distance to the vehicle collision point is less than the predefined informing distance. If ECU 120 determines that the current distance to the vehicle collision point is not less than the predefined informing distance, ECU 120 may proceed to step 1412, where ECU 120 determines that there is no threat. Otherwise, ECU 120 proceeds to step 1414.

During step 1414, ECU 120 determines if the current distance to the vehicle collision point is less than the predefined warning distance. If ECU 120 determines that the current distance to the vehicle collision point is not less than the predefined warning distance, ECU 120 may proceed to step 1416. During step 1416, ECU 120 determines that there is a low threat level. If, during step 1414, ECU 120 determines that the current distance to the vehicle collision point is less than the predefined warning distance, ECU 120 proceeds to step 1418. During step 1418, ECU 120 determines that there is a high threat level.

It will be understood that the current embodiment of a process for determining a threat of collision is only intended to be exemplary. Generally, any method of determining a threat level according to information related to a primary vehicle and a remote vehicle may be used. In other embodiments, a collision warning system can use another process for determining a threat of collision. For example, in another embodiment, rather than calculating a distance to the vehicle collision point, a time to vehicle collision point can be calculated and compared with a predefined informing alert time as well as a predefined warning alert time.

In some situations, a motor vehicle may slow down to a speed below a threshold speed near a potential intersection, even though the driver does not intend to turn at the potential intersection. For example, if a leading vehicle is stopped at an intersection further down the road, the driver may slow down near a potential intersection without any intention to turn at the intersection. The collision warning system could then incorrectly determine that the potential intersection is the identified intersection, which may lead to alerts from the collision warning system that are a nuisance to the driver. A collision warning system can include provisions for reducing nuisance alerts due to a driver slowing a motor vehicle because of the travel of leading vehicles at upcoming intersections.

Figure 15:
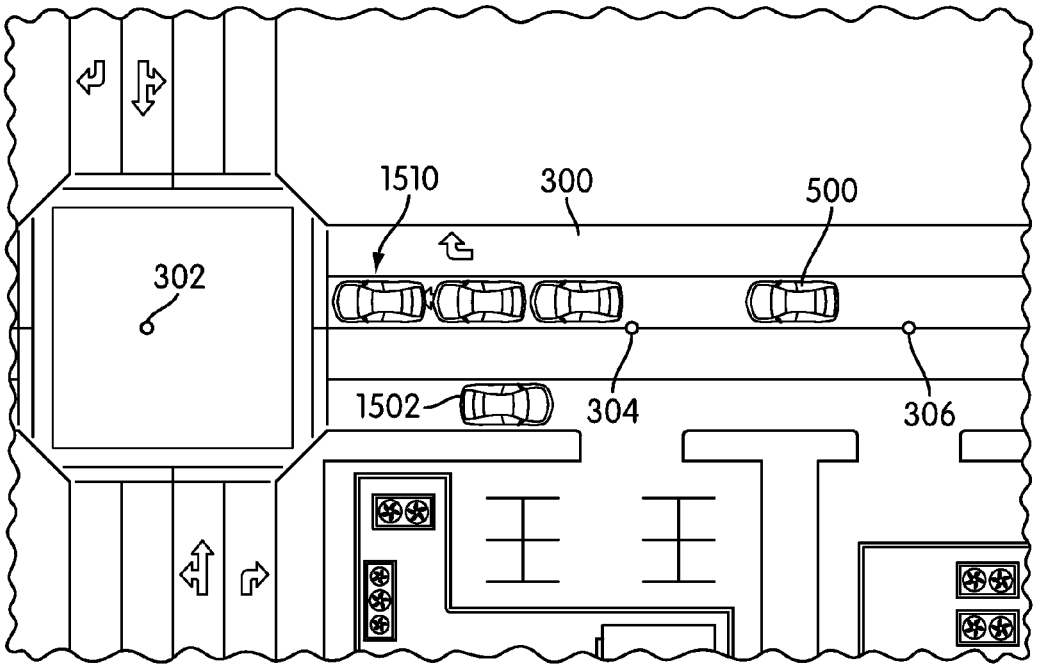
FIG. 15 is a schematic view of an embodiment of a method of controlling a collision warning system.
Figure 16:
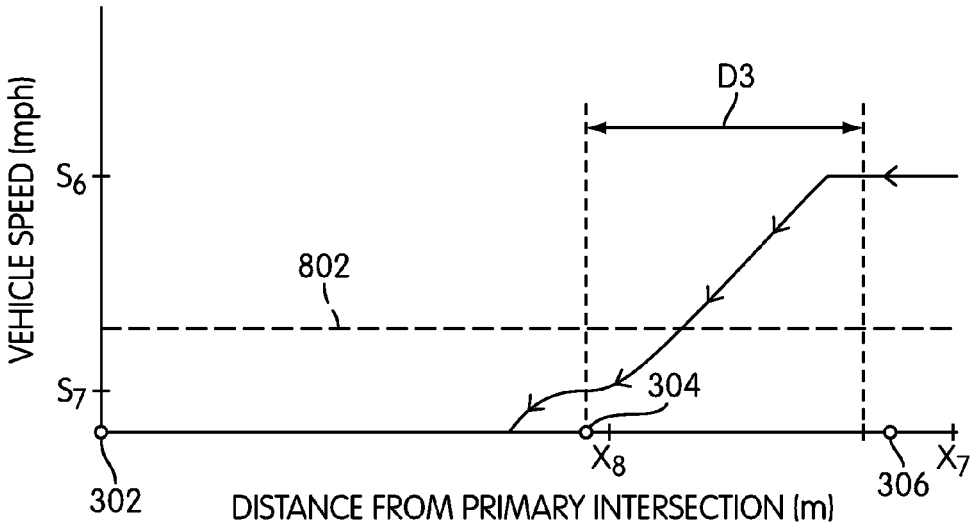
FIG. 16 is a schematic view of an embodiment of a method of controlling a collision warning system.

FIGS. 15 and 16 illustrate an embodiment of situation where a collision warning system may incorrectly determine an identified intersection. Referring to FIGS. 15 and 16, motor vehicle 500 may be traveling on first roadway 300 towards first intersection 302. Additionally, remote vehicle 1502 may be traveling in an opposing lane near second intersection 304. Furthermore, several leading vehicles 1510 may be stopped at intersection 302, which are waiting to make a left turn at intersection 302.

In this embodiment, the driver of motor vehicle 500 may intend to turn left at first intersection 302. However, to avoid colliding with leading vehicles 1510, motor vehicle 500 may slow from an initial speed S6 at position X7 to speed S7 at position X8. Since speed S7 is below speed threshold 802, and since motor vehicle 500 is within second threshold distance D3 of second intersection 304, the collision warning system may mistakenly identify second intersection 304 as the intended turning intersection. In this case, if the collision warning system displays an alert for the driver related to a potential collision with remote vehicle 1502, the driver may be annoyed and the driver reliance on the system may be diminished.

A collision warning system can include provisions for reducing nuisance alerts caused by improper intersection identification. In some embodiments, the collision warning system can include provisions for modifying the alert level of the collision warning system according to the presence of one or more leading vehicles at a nearby intersection.

Figure 17:
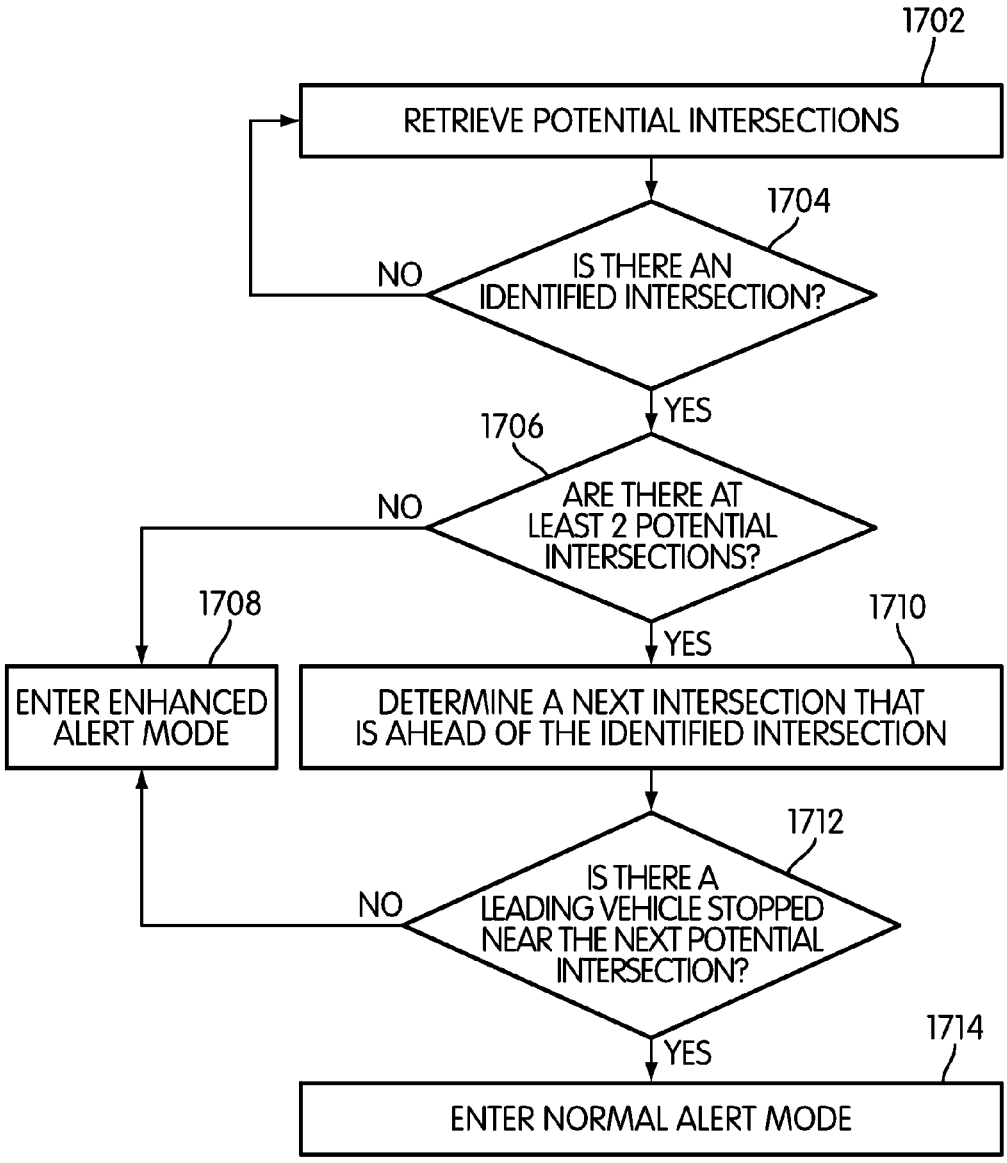
FIG. 17 is an embodiment of a process for controlling a collision warning system.

FIG. 17 illustrates an embodiment of a process of modifying a collision warning system to reduce nuisance alerts caused by improper intersection identification. In this embodiment, the following steps may be performed by ECU 120; however in some embodiments these steps may be performed by additional systems or devices associated with motor vehicle 500. In addition, it will be understood that in other embodiments one or more of the following steps may be optional.

During step 1702, ECU 120 may retrieve the set of potential intersections. Next, during step 1704, ECU 120 may determine if there is an identified intersection. If there is an identified intersection, ECU 120 may proceed to step 1706. Otherwise, ECU 120 may proceed back to step 1702. In some cases, the set of potential intersections can be updated during step 1702.

During step 1706, ECU 120 may determine if there are at least two potential intersections. If there is only a single potential intersection, there is no way of identifying leading vehicles at a nearby intersection and therefore ECU 120 may proceed to step 1708. During step 1708, ECU 120 puts the collision warning system in an enhanced alert mode.

On the other hand, if during step 1706 ECU 120 determines that there are at least two potential intersections in the set of potential intersections, then ECU 120 may proceed to step 1710. During step 1710, ECU 120 may determine a next intersection that is located ahead of the identified intersection. For example, referring back to the scenario illustrated in FIG. 15, second intersection 304 is the identified intersection and first intersection 302 is the next intersection that is located ahead of second intersection 304 from the perspective of motor vehicle 500.

Following step 1710, ECU 120 may proceed to step 1712. During step 1712, ECU 120 may determine if there is a leading vehicle stopped near the next potential intersection. In different embodiments, the presence and location of the leading vehicle can be determined in various ways. In some cases, the presence and location of the leading vehicle can be determined using information received from the leading vehicle over a vehicle communication network. This information can be used to determine the location of the leading vehicle relative to the next intersection as well as if the leading vehicle is stopped. In other cases, the presence and location of the leading vehicle can be determined using a remote detection device. In addition, the remote detection device can also be used to determine if the leading vehicle is stopped.

It will be understood that although the current embodiment discusses a method of determining if a leading vehicle is stopped near the next intersection, in other embodiments the method could be modified to determine if the leading vehicle is moving at a substantially low speed at the next intersection. For example, in another embodiment, a motor vehicle could slow down well ahead of an intersection if a leading vehicle is moving substantially slowly at the intersection. In other embodiments, for example, the method discussed here for modifying a collision warning system when a leading vehicle is traveling below a predetermined speed at a nearby intersection.

If, during step 1712, ECU 120 determines that there is a leading vehicle stopped near the next potential intersection, ECU 120 may proceed to step 1714. Otherwise, ECU 120 may proceed back to step 1708 to put the collision warning system in the enhanced alert mode.

During step 1714, ECU 120 may put the collision warning system in the normal alert mode. In some cases, the normal alert mode is a mode where only warning alerts are displayed and informing alerts are not displayed. This arrangement can help reduce nuisance alerts that may occur at an intersection due to incorrect intersection identification that can occur when a motor vehicle slows to avoid colliding with one or more leading vehicles.

Although the current embodiment illustrates a process for detecting if a leading vehicle is stopped near an intersection ahead of the currently identified intersection, in other embodiments the operation of a collision warning system could be modified if a leading vehicle is slowing near the next intersection, which could also cause a driver to slow ahead of the intended intersection. Furthermore, in other embodiments, a collision warning system could be modified according to other operating parameters of one or more leading vehicles.

A collision warning system can include provisions for reducing nuisance alerts that occur when a motor vehicle is approaching an intersection without any significant chance for colliding with a remote vehicle that is also passing through the intersection. For example, if a motor vehicle approaches an intersection with a leading vehicle waiting to turn at the same intersection, there is little chance for collision with a remote vehicle passing through the intersection at that moment. Similarly, if a motor vehicle is stopped at an intersection, there is little chance for a collision with a remote vehicle passing through the intersection. Additionally, if a motor vehicle is approaching an intersection and the driver has an unobstructed view of a remote vehicle passing through an oncoming traffic lane of the intersection, there is little chance for collision with the remote vehicle.

Figure 18:
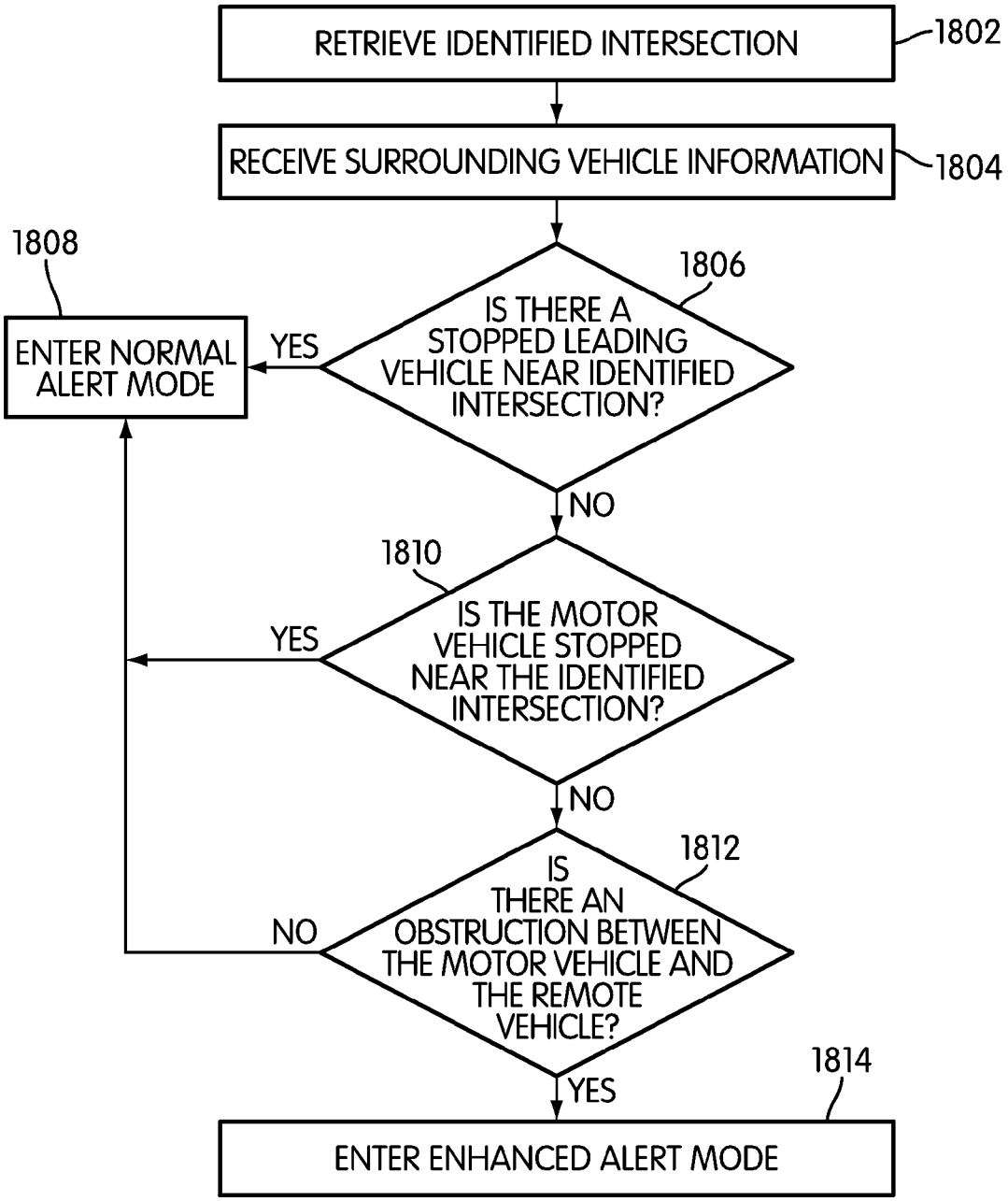
FIG. 18 is an embodiment of a process for controlling a collision warning system.

FIG. 18 illustrates an embodiment of a process for reducing nuisance alerts from a collision warning system in situations where the chance of collision with a remote vehicle at an intersection is very low. In this embodiment, the following steps may be performed by ECU 120; however in some embodiments these steps may be performed by additional systems or devices associated with motor vehicle 500. In addition, it will be understood that in other embodiments one or more of the following steps may be optional.

During step 1802, ECU 120 may receive the identified intersection. Next, during step 1804, ECU 120 may receive information from nearby or surrounding vehicles. Following this, during step 1806, ECU 120 may determine if there is a stopped leading vehicle near the identified intersection. If there is a stopped leading vehicle near the identified intersection, ECU 120 may proceed to step 1808 where ECU 120 may put the collision warning system in the normal alert mode. During the normal alert mode, only warning alerts may be issued. This may help reduce any nuisance to a driver caused by issuing informing alerts in the situation where a leading vehicle is stopped ahead of the host vehicle at the identified intersection. If, during step 1806 ECU 120 determines that there is no stopped leading vehicle, ECU 120 may proceed to step 1810.

During step 1810, ECU 120 may determine if the motor vehicle is stopped near the identified intersection. If so, ECU 120 may proceed to step 1808. Otherwise, ECU 120 may proceed to step 1812. During step 1812, ECU 120 may determine if there is an obstruction between the motor vehicle and the remote vehicle in the oncoming traffic lane. If there is no obstruction, ECU 120 may proceed to step 1806. Otherwise, ECU 120 may proceed to step 1814. During step 1814, ECU 120 may put the collision warning system in the enhanced alert mode, since there is a greater threat for collision in this situation.

In different embodiments, the step of detecting an obstruction could be accomplished in various ways. In some cases, an obstruction could be detected using a camera or other visual detection system. In other cases, an obstruction could be detected according to one or more signal characteristics of a received signal from a vehicle communication network. In still other cases where another vehicle provides the obstruction, the obstruction could be detected according to information received regarding the obstructing vehicle over the vehicle communication network. Examples of methods for determining if an object is obstructing the view of a motor vehicle can be found in copending and commonly owned U.S. Pat. No. 8,558,718, currently U.S. patent application Ser. No. 12/885,790, entitled "Method of Controlling a Collision Warning System Using Line of Sight", and filed on Sep. 20, 2010, which is incorporated by reference in its entirety.

It will be understood that while the current embodiments discuss a method of identifying an intersection for purposes of controlling a collision warning system, in other embodiments the method of identifying an intersection could be applied to other systems of a motor vehicle. For example, other types of vehicle safety systems that activate safety features in a vehicle could utilize the method of identifying an intersection discussed above. Furthermore, the methods could be applied to any other systems of a motor vehicle that require information about an intersection where a driver may intend to turn.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of operating a motor vehicle, comprising the steps of:

receiving intersection information;

retrieving a predetermined distance;

determining a set of potential intersections from the intersection information, the set of potential intersections including all the intersections that are less than the predetermined distance in front of the motor vehicle;

selecting an identified intersection from the set of potential intersections;

determining a vehicle speed of the motor vehicle;

determining whether the vehicle speed has slowed to below a threshold speed and whether a distance from the motor vehicle to the identified intersection is less than the predetermined distance;

receiving information from a remote vehicle;

estimating a vehicle collision point for the motor vehicle and the remote vehicle based upon the information received from the remote vehicle;

determining a threat level according to the identified intersection, the vehicle speed, the distance from the motor vehicle to the identified intersection and the estimated vehicle collision point for the motor vehicle and the remote vehicle;

and controlling a collision warning system of the motor vehicle according to the threat level.

2. The method according to claim 1, further comprising providing exit information associated with the identified intersection.

3. The method according to claim 1, wherein the intersection information is received from one of a navigation system and a map database, and wherein the method further comprises determining whether a driver of the motor vehicle intends to turn the motor vehicle.

4. The method according to claim 1, wherein the intersection information includes locations of residential driveways.

5. The method according to claim 1, wherein the intersection information includes locations of commercial driveways.

6. A method of operating a motor vehicle with a driver, comprising the steps of:

receiving intersection information;

determining a vehicle speed;

determining at least one potential intersection;

determining whether the driver intends to turn the motor vehicle to the left;

determining a distance from the motor vehicle to the at least one potential intersection;

retrieving a threshold speed and a threshold distance;

setting the potential intersection as an identified intersection when the driver has slowed the vehicle speed to below the threshold speed and when the distance is below the threshold distance; and controlling a collision warning system of the motor vehicle according to the identified intersection wherein the step of controlling the collision warning system includes steps of receiving information from a remote vehicle, determining if the remote vehicle is close to the identified intersection, and estimating a collision point for the motor vehicle and the remote vehicle based upon the information received from the remote vehicle.

7. The method according to claim 6, wherein the step of determining at least one potential intersection includes steps of retrieving a predetermined distance and determining a set of potential intersections from the intersection information, the set of potential intersections including all the intersections that are less than the predetermined distance in front of the motor vehicle.

8. The method according to claim 6, wherein the value of the threshold speed varies for different intersections.

9. The method according to claim 6, wherein the value of the threshold distance varies for different intersections.

10. A method of operating a motor vehicle, comprising the steps of:

receiving intersection information;

determining a vehicle speed;

determining at least one potential intersection;

determining a distance from the motor vehicle to the at least one potential intersection;

retrieving a threshold speed and a threshold distance;

setting the potential intersection as an identified intersection when the vehicle speed is below the threshold speed and when the distance is below the threshold distance; and controlling a collision warning system of the motor vehicle according to the identified intersection;

wherein the step of controlling the collision warning system further comprises steps of:

determining a next intersection from the set of potential intersections, the next intersection being further in front of the motor vehicle than the identified intersection;

determining if there is a stopped leading vehicle at the next intersection;

if there is a stopped leading vehicle at the next intersection, determining that the chance for a collision with a remote vehicle is low and controlling a collision warning system of the motor vehicle in a normal alert mode providing normal alert information to a driver of the motor vehicle;

if there is not a stopped leading vehicle at the next intersection, determining that the chance for a collision requires controlling the collision warning system in an enhanced alert mode providing enhanced alert information to the driver of the motor vehicle;

wherein the enhanced alert mode is different than the normal alert mode.

11. The method according to claim 10, wherein the collision warning system issues more alerts in the enhanced alert mode than in the normal alert mode.

12. A method of operating a motor vehicle, comprising the steps of:

receiving intersection information;

determining an identified intersection and a next intersection from a set of potential intersections, the next intersection being further in front of the motor vehicle than the identified intersection;

determining if there is a stopped leading vehicle at the next intersection;

determining whether a driver of the motor vehicle intends to turn the motor vehicle;

determining whether a vehicle speed of the motor vehicle has slowed to below a threshold speed;

determining whether there is a stopped vehicle at the next intersection;

if there is a stopped vehicle at the next intersection, determining that the chance for a collision with a remote vehicle is low and controlling a collision warning system of the motor vehicle in a normal alert mode; and if there is not a stopped vehicle at the next intersection, determining that the chance of a collision requires controlling the collision warning system in an enhanced alert mode when there is not a stopped leading vehicle at the next intersection;

wherein the enhanced alert mode is different than the normal alert mode.

13. The method according to claim 12, wherein the method further includes steps of:

determining if there is a slowing leading vehicle at the next intersection;

controlling a collision warning system of the motor vehicle in the normal alert mode when there is a slowing leading vehicle at the next intersection; and controlling the collision warning system in the enhanced alert mode when there is not a slowing leading vehicle at the next intersection.

14. The method according to claim 12, wherein the method includes a step of determining if there is a stopped leading vehicle at the identified intersection and wherein the collision warning system is operated in the normal alert mode if there is a stopped leading vehicle at the identified intersection.

15. The method according to claim 12, wherein the method includes a step of determining if the motor vehicle is stopped at the identified intersection and wherein the collision warning system is operated in the normal alert mode if the motor vehicle is stopped at the identified intersection.

16. The method according to claim 12, wherein the step of determining an identified intersection further includes the steps of:

determining a vehicle speed for the motor vehicle;

selecting at least one potential intersection from the set of potential intersections;

determining a distance from the motor vehicle to the at least one potential intersection;

retrieving a threshold speed and a threshold distance; and setting the potential intersection as an identified intersection when the vehicle speed is below the threshold speed and when the distance is below the threshold distance.

17. The method according to claim 12, wherein the set of potential intersections comprises all intersections within a predetermined distance in front of the motor vehicle.

18. The method according to claim 12, wherein the step of determining if there is a stopped leading vehicle at the next intersection includes a step of receiving information from the leading vehicle using a vehicle communication network.

19. The method according to claim 10, further comprising a step of providing exit information associated with the identified intersection to the driver of the motor vehicle.

20. The method according to claim 10, further comprising a step of receiving information from a remote vehicle and a step of estimating a vehicle collision point between the motor vehicle and the remote vehicle.

21. The method of claim 10, wherein the step of determining if there is a stopped vehicle at the next intersection comprises using a visual detection system.

* * * * *